US007325894B2

(12) United States Patent
Kodama

(10) Patent No.: US 7,325,894 B2
(45) Date of Patent: Feb. 5, 2008

(54) LIQUID DROPLET DISCHARGE HEAD, LIQUID DROPLET DISCHARGE DEVICE, AND IMAGE FORMING APPARATUS

(75) Inventor: Kenichi Kodama, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 367 days.

(21) Appl. No.: 11/085,225

(22) Filed: Mar. 22, 2005

(65) Prior Publication Data

US 2005/0212875 A1 Sep. 29, 2005

(30) Foreign Application Priority Data

Mar. 23, 2004 (JP) ..... 2004-085273

(51) Int. Cl.
*B41J 2/195* (2006.01)

(52) U.S. Cl. ..... 347/7

(58) Field of Classification Search ..... 347/7, 347/54, 56, 57, 63

See application file for complete search history.

(56) References Cited

U.S. PATENT DOCUMENTS

| | | | | |
|---|---|---|---|---|
| 5,841,448 | A | 11/1998 | Moriyama et al. | |
| 6,341,852 | B1 * | 1/2002 | Yamamoto | 347/85 |
| 6,827,411 | B2 * | 12/2004 | Kubota et al. | 347/7 |
| 7,125,101 | B2 * | 10/2006 | Cruz-Uribe et al. | 347/51 |

FOREIGN PATENT DOCUMENTS

| | | | |
|---|---|---|---|
| JP | 1-83546 | U | 6/1989 |
| JP | 7-232440 | A | 9/1995 |
| JP | 2000-15841 | A | 1/2000 |

* cited by examiner

*Primary Examiner*—Anh T. N. Vo
(74) *Attorney, Agent, or Firm*—Birch, Stewart, Kolasch & Birch, LLP

(57) ABSTRACT

The liquid droplet discharge head comprises: a plurality of nozzles which discharge droplets of liquid; and a first flow channel section and a second flow channel section connected to at least one of the plurality of nozzles, wherein: at least a portion of a flow channel member forming at least one of the first flow channel section and the second flow channel section has light transmitting properties; and a member which selectively reflects or transmits light is disposed between the first flow channel section and the second flow channel section.

9 Claims, 22 Drawing Sheets

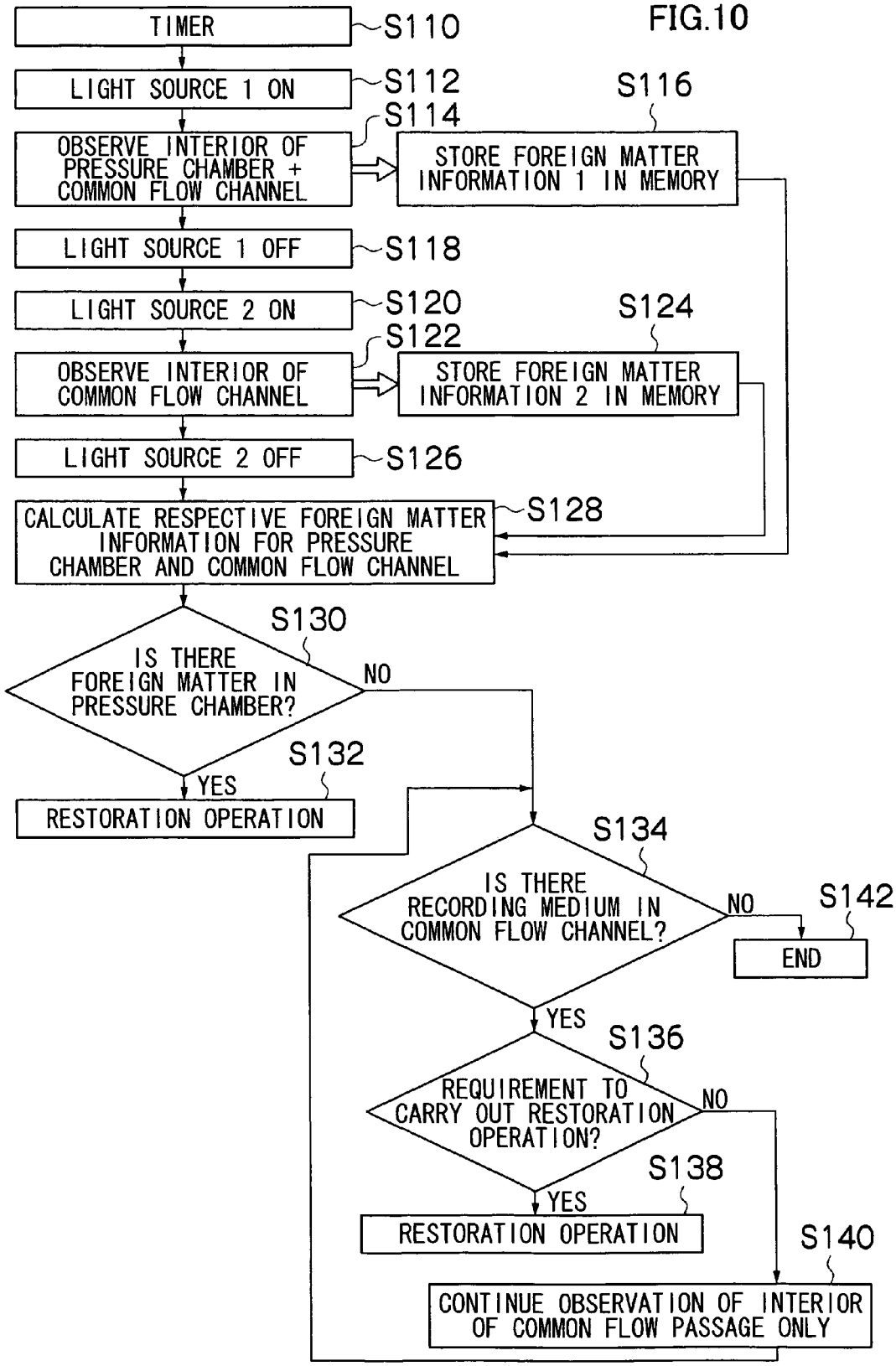
FIG.10
TIMER
S110
LIGHT SOURCE 1 ON
S112
S114
OBSERVE INTERIOR OF PRESSURE CHAMBER + COMMON FLOW CHANNEL
S116
STORE FOREIGN MATTER INFORMATION 1 IN MEMORY
LIGHT SOURCE 1 OFF
S118
LIGHT SOURCE 2 ON
S120
S122
OBSERVE INTERIOR OF COMMON FLOW CHANNEL
S124
STORE FOREIGN MATTER INFORMATION 2 IN MEMORY
LIGHT SOURCE 2 OFF
S126
CALCULATE RESPECTIVE FOREIGN MATTER INFORMATION FOR PRESSURE CHAMBER AND COMMON FLOW CHANNEL
S128
S130
IS THERE FOREIGN MATTER IN PRESSURE CHAMBER?
NO
YES
S132
RESTORATION OPERATION
S134
IS THERE RECORDING MEDIUM IN COMMON FLOW CHANNEL?
NO
S142
END
YES
S136
REQUIREMENT TO CARRY OUT RESTORATION OPERATION?
NO
S138
YES
RESTORATION OPERATION
S140
CONTINUE OBSERVATION OF INTERIOR OF COMMON FLOW PASSAGE ONLY

CIRCULARLY POLARIZED LIGHT
522
532
541
544
534
524

522
532
541
544
534
524

LIQUID DROPLET DISCHARGE HEAD, LIQUID DROPLET DISCHARGE DEVICE, AND IMAGE FORMING APPARATUS

BACKGROUND OF THE INVENTION

1. Field of the Invention

The present invention relates to a liquid droplet discharge head, a liquid droplet discharge device and an image forming apparatus, and more particularly, to a structure of a liquid droplet discharge head which are suitable for use in an image forming apparatus, such as an inkjet recording apparatus which forms images on a recording medium by discharging liquid droplets from nozzles, and to a technology for determining discharge errors in the liquid droplet discharge head.

2. Description of the Related Art

An inkjet recording apparatus is an apparatus for forming images by means of ink dots, by causing ink to be discharged from a recording head comprising nozzles for discharging ink, in accordance with a print signal, thereby causing ink droplets to land on a recording medium, such as recording paper, or the like, while moving the recording medium relatively with respect to the recording head. In an apparatus of this kind, if an air bubble is present in the nozzles of the flow channel in the vicinity of the nozzles, then a problem arises in that the ink cannot be discharged normally. Therefore, technologies have been proposed for judging the presence or absence of air bubbles through optical observation of the flow channels inside the head.

Japanese Utility Model Application Publication No. 1-83546 discloses technology for determining air bubbles inside the flow channels of the head by means of an optical device. Japanese Patent Application Publication No. 7-232440 proposes the use of infrared light as the wavelength of the determination light source. Japanese Patent Application Publication No. 2000-15841 proposes that a portion of the flow channel be constituted by a transparent member, the wavelength of the determination light source being varied in accordance with the type (color) of ink, and also proposes that the satisfactory or unsatisfactory discharge status be judged by processing a determination image obtained by scanning the determination system in the direction in which nozzles are arranged.

However, the technologies proposed in the prior art are applicable only to heads having a relatively simple structure, and are not compatible, for example, with heads having a complicated structure, such as those where the internal flow channels (including the liquid chambers) are arranged three-dimensionally in an overlapping fashion, by means of a layered structure. For example, a head composition has been devised in which the flow channel sections, such as the pressure chambers and common flow channels, are arranged in a layered structure, in order to achieve higher nozzle density. If the technologies proposed in the prior art are applied to a head of this kind, then although the liquid chambers in the vicinity of the determination system can be observed, those liquid chambers which are distant from the determination system cannot be observed because they are shielded from view by the liquid chambers in front of them. Even supposing that a transparent material is used to compose all of the members forming the flow channels in the head, then while the locations of air bubbles can be specified in the planar direction captured by the optical sensor, it is difficult to identify their location in the depth direction, namely, to identify which layer of liquid chambers, of the plurality of liquid chambers arranged in different layers, the air bubbles are located in.

SUMMARY OF THE INVENTION

The present invention has been contrived in view of such circumstances, and an object thereof is to provide a liquid droplet discharge head, a liquid droplet discharge device and an image forming apparatus using same which is able to judge the presence or absence of foreign matter, such as air bubbles, and to determine the location of same, inside a head having a complex flow channel structure comprising a plurality of flow channel sections arranged-in a three-dimensional overlapping fashion.

In order to attain the aforementioned object, the present invention is directed to a liquid droplet discharge head, comprising: a plurality of nozzles which discharge droplets of liquid; and a first flow channel section and a second flow channel section connected to at least one of the plurality of nozzles, wherein: at least a portion of a flow channel member forming at least one of the first flow channel section and the second flow channel section has light transmitting properties; and a member which selectively reflects or transmits light is disposed between the first flow channel section and the second flow channel section.

According to the present invention, the first flow channel section and the second flow channel section inside the liquid droplet discharge head, which contain liquid for discharging, are disposed respectively on either side of a member which reflects or transmits light, selectively. Furthermore, at least a portion of the flow channel member forming at least one of the first flow channel section and the second flow channel section has light transmitting properties. Therefore, it is possible to observe the interior of the flow channels optically, through a light transmitting portion of the flow channel member (in other words, a transparent portion). Moreover, by selectively reflecting or transmitting the observation light (determination light) by means of a member interposed between the first flow channel section and the second flow channel section (hereafter, called "selective reflecting/transmitting member, where necessary), it is possible to observe, selectively, the internal state of a flow channel section disposed in front of (on the near side of) this member, and the internal state of a flow channel section disposed behind (on the far side of) this member.

The first flow channel section and the second flow channel section may be mutually connected, or they may be unconnected. Naturally, they may be flow channels supplying liquid to the same nozzle, or they may be flow channels supplying liquid to different nozzles. Moreover, the positional relationship of the first flow channel section and the second flow channel section may be an upper/lower relationship, a left/right relationship, or an oblique relationship.

The first and second flow channel sections may be liquid chambers which store a prescribed amount of liquid, or they may be liquid transfer channels which connect respective liquid chambers. For example, the first flow channel section is a pressure chamber connected to a nozzle, which is filled with liquid that is to be discharged from the nozzle, and the second flow channel section is a common flow channel that supplies liquid to the pressure chamber. Other modes apart from this are possible, for instance, the first flow channel section and the second flow channel section may both be pressure chambers, or the first flow channel section and the second flow channel section may both be common flow channels.

Preferably, the liquid droplet discharge head further comprises: a nozzle plate which constitutes a portion of at least one of the first flow channel section and the second flow channel section, the plurality of nozzles being formed in the nozzle plate; and an actuator which is provided on a discharge face side of the nozzle plate and causes the droplets of the liquid to be discharged from the nozzles by generating a pressure change in the liquid inside at least one of the first flow channel section and the second flow channel section.

In a liquid droplet discharge head having a structure in which an actuator for causing discharge is provided on the discharge surface side of a nozzle plate, it is possible to dispose a flow channel member having light transmitting properties on the rear side of the head. Therefore, since elements which obstruct external observation (namely, the discharge actuator and wiring members relating to same, etc.) are not situated on the rear side of the head, it is possible to observe the flow channels inside the head, readily, from the rear surface side of the head.

The present invention is also directed to a liquid droplet discharge device, comprising: the liquid droplet discharge head as described above; a light emitting device which irradiates light onto the at least one of the first flow channel section and the second flow channel section through the portion of the flow channel member having the light transmitting properties; and a light receiving device which determines a status inside the at least one of the first flow channel section and the second flow channel section through the portion of the flow channel member having the light transmitting properties.

The light emitted from the light emitting device is directed inside the head via the light-transmitting portion of the flow channel member, and the resulting reflected light or transmitted light is determined by the light receiving device. By selectively reflecting or transmitting the determination light by means of a selective reflecting/transmitting member positioned between the first flow channel section and the second flow channel section, it is possible to determine, selectively, the internal state of a flow channel section disposed in front of (on the near side of) this member, and the internal state of a flow channel section disposed behind (on the far side of) this member.

Preferably, an optical determination unit including the light emitting device and the light receiving device is supported movably with respect to the liquid droplet discharge head.

Desirably, a composition is adopted which allows the determination position or the determination range to be changed, by forming the optical determination device including a light emitting device and a light receiving device into a unit, and moving this optical determination unit with respect to the liquid droplet discharge head.

Preferably, the member disposed between the first flow channel section and the second flow channel section is a dielectric multi-layer film mirror having optical characteristics whereby the member transmits light of a prescribed transmission wavelength range and reflects light of a prescribed reflection wavelength range.

By using a dielectric multi-layer film mirror, it is possible to achieve optical characteristics whereby only light of a particular wavelength range is transmitted and light of other wavelengths is reflected, and hence this type of mirror is suitable for implementing the present invention.

Preferably, the light emitting device comprises a first light source which irradiates light of a wavelength included in the prescribed transmission wavelength range, and a second light source which irradiates light of a wavelength included in the prescribed reflection wavelength range.

By combining a first light source included in the transmission wavelength range and a second light source included in the reflection wavelength range, according to the characteristics of the dielectric multi-layer film mirror, the light from the first light source passes through the dielectric multi-layer film mirror and reaches the flow channel section positioned on the far side of the mirror. Furthermore, the light from the second light source is reflected by the dielectric multi-layer film mirror, and hence does not reach the region beyond the mirror. Consequently, by receiving the light of the first light source that is transmitted through the dielectric multi-layer film mirror, at the light receiving device, it is possible to obtain information relating to the flow channel section on the far side of the mirror, and by receiving the light of the second light source that is reflected by the dielectric multi-layer film mirror, it is possible to obtain information relating to the flow channel section on the near side of the mirror.

Preferably, the liquid droplet discharge device further comprises: a light source control device which switches selectively between irradiation of light by the first light source and light by the second light source, onto the portion of the flow channel member having the light transmitting properties; and a foreign matter judgment device which judges presence and absence of foreign matter inside the flow channel sections, and a position of foreign matter, if foreign matter is present, according to first determination information obtained from the light receiving device during irradiation of light from the first light source, and second determination information obtained from the light receiving device during irradiation of light from the second light source.

The first determination information determined by means of the light of the first light source, which is transmitted by the dielectric multi-layer film mirror, contains information relating to the flow channel section situated on the far side of the dielectric multi-layer film mirror, while the second determination information determined by means of the light of the second light source, which is reflected by the dielectric multi-layer film mirror, contains information relating to the flow channel section situated on the near side of the mirror, and does not contain information relating to the flow channel section on the far side of the mirror. Therefore, it is possible to identify the presence or absence of foreign matter, and the position of any foreign matter, from the first and second determination information.

This is achieved, for example, by providing a storage device (first storage device) for storing the first determination information, a storage device (second storage device) for storing the second determination information, and a calculating device which calculates the presence or absence of foreign matter, and the position of same, from the information held in these storage devices.

Preferably, the liquid droplet discharge device further comprises: a restoration device which restores discharge performance of the liquid droplet discharge head; and a restoration control device which controls a restoration operation performed by the restoration device, according to a judgment result from the foreign matter judgment device.

If the presence of foreign matter, such as an air bubble, is confirmed by the foreign matter judgment device and the position of that foreign matter is ascertained, then desirably, it is judged whether or not the foreign matter has an adverse effect on the discharge of liquid, and if it is judged that countermeasures are necessary, then a restoration operation is carried out by means of a restoring device. A restoration operation may be a preliminary discharge, or an operation of suctioning the liquid inside the head, or the like.

Preferably, the light receiving device comprises a first light receiving section having a determination wavelength peak sensitivity included in the prescribed transmission wavelength range, and a second light receiving section having a determination wavelength peak sensitivity included in the prescribed reflection wavelength range.

By providing a plurality of light receiving sections having different peak sensitivities in the light receiving device, in accordance with the wavelength ranges of the determination light, it is possible to achieve even higher determination accuracy. Furthermore, according to this mode, it is also possible to use a light source having a broad wavelength range which covers both the transmission wavelength range and the reflection wavelength range, as the light emitting device, and hence the composition of the light source section can be simplified.

Preferably, the member disposed between the first flow channel section and the second flow channel section is a cholesteric liquid crystal having optical characteristics whereby reflection and transmission of light is controllable in accordance with an applied voltage.

The cholesteric liquid crystal has long thin molecules which are mutually parallel within the each layer, but between layers, the direction of orientation differs slightly on the basis of a prescribed correlation, thereby forming a spiral structure in the respective layers. This structure reflects circularly polarized light. When a voltage is applied to this cholesteric liquid crystal, the molecular arrangement changes and light is transmitted through the crystal. These properties are utilized to enable the determination light of a particular wavelength to be reflected or transmitted, selectively.

Preferably, circularly polarized light is irradiated from the light emitting device. Since the cholesteric liquid crystal has properties whereby it reflects circularly polarized light, as described above, then desirably, the light irradiated by the light emitting device is circularly polarized light.

Preferably, the liquid droplet discharge device further comprises: a voltage control device which controls the voltage applied to the cholesteric liquid crystal; and a foreign matter judgment device which judges presence and absence of foreign matter inside the flow channel sections, and a position of the foreign matter, if foreign matter is present, according to first determination information obtained from the light receiving device when the cholesteric liquid crystal is in a light transmitting state, and second determination information obtained from the light receiving device when the cholesteric liquid crystal is in a light reflecting state.

By controlling the voltage applied to the cholesteric liquid crystal, it is possible to switch the liquid crystal between a state in which it reflects circularly polarized light and a state in which it transmits same. The first determination light determined when the liquid crystal is in a light transmitting state contains information relating to the flow channel section situated on the far side of the cholesteric liquid crystal. On the other hand, the second determination information determined when the liquid is in a circularly polarized light reflecting state includes information relating to the flow channel section situated on the near side of the cholesteric liquid crystal, and it does not include information relating to the flow channel section on the far side of the liquid crystal. Therefore, it is possible to identify the presence or absence or foreign matter, and the position of the foreign matter, accurately, on the basis of the first and second determination information.

The present invention is also directed to an image forming apparatus, comprising the liquid droplet discharge device as described above, the image forming apparatus forming an image by means of a liquid discharged from the nozzles.

The liquid droplet discharge device described above can be used appropriately in an image forming apparatus, such as an inkjet recording apparatus.

Moreover, for the discharge head, it is possible to use a full line type recording head having a nozzle row in which a plurality of nozzles that discharge ink are arranged through a length corresponding to the full width of the recording paper (discharge receiving medium) in a direction substantially perpendicular to the relative direction of conveyance of the recording medium.

A "full-line recording head (droplet discharging head)" is normally disposed along the direction orthogonal to the relative feed direction (direction of relative movement) of the printing medium, but also possible is an aspect in which the recording head is disposed along the diagonal direction given a predetermined angle with respect to the direction orthogonal to the feed direction. The array form of the nozzles in the recording head is not limited to a single row array in the form of a line, and a matrix array composed of a plurality of rows is also possible. Also possible is an aspect in which a plurality of short-length recording head units having a row of nozzles that do not have lengths that correspond to the entire width of the printing medium are combined, whereby the image-recording element rows are configured so as to correspond to the entire width of the printing medium, with these units acting as a whole.

The "recording medium" is a medium (an object that may be referred to as a print medium, image formation medium, recording medium, image receiving medium, or the like) that receives images recorded by the action of the recording head and includes continuous paper, cut paper, seal paper, OHP sheets, and other resin sheets, as well as film, cloth, printed substrates on which wiring patterns or the like are formed with an inkjet recording apparatus, and various other media without regard to materials or shapes. In the present specification, the term "printing" expresses the concept of not only the formation of characters, but also the formation of images with a broad meaning that includes characters.

The term "moving device (conveyance device)" includes an aspect in which the printing medium is moved with respect to a stationary (fixed) recording head, an aspect in which the recording head is moved with respect to a stationary printing medium, or an aspect in which both the recording head and the printing medium are moved.

According to the present invention, a member having properties whereby it selectively reflects or transmits light is provided inside the liquid droplet discharge head, and a first flow channel section and a second flow channel section are formed on either side of the member. Furthermore, at least a portion of the flow channel member forming at least one of the first flow channel section and the second flow channel section is formed by a light transmitting member. Therefore, it is possible to observe, selectively, the interior of the first flow channel section and the interior of the second flow channel section, by means of an optical observation (determination) device. Thereby, it is possible to ascertain accurately the presence/absence of foreign matter, and the position of foreign matter, inside the flow channels of the head.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 10 is a flowchart showing an example of a sequence for determining discharge in an inkjet recording apparatus according to the present embodiment;

DETAILED DESCRIPTION OF THE PREFERRED EMBODIMENTS

General Configuration of an Inkjet Recording Apparatus

Figure 1:
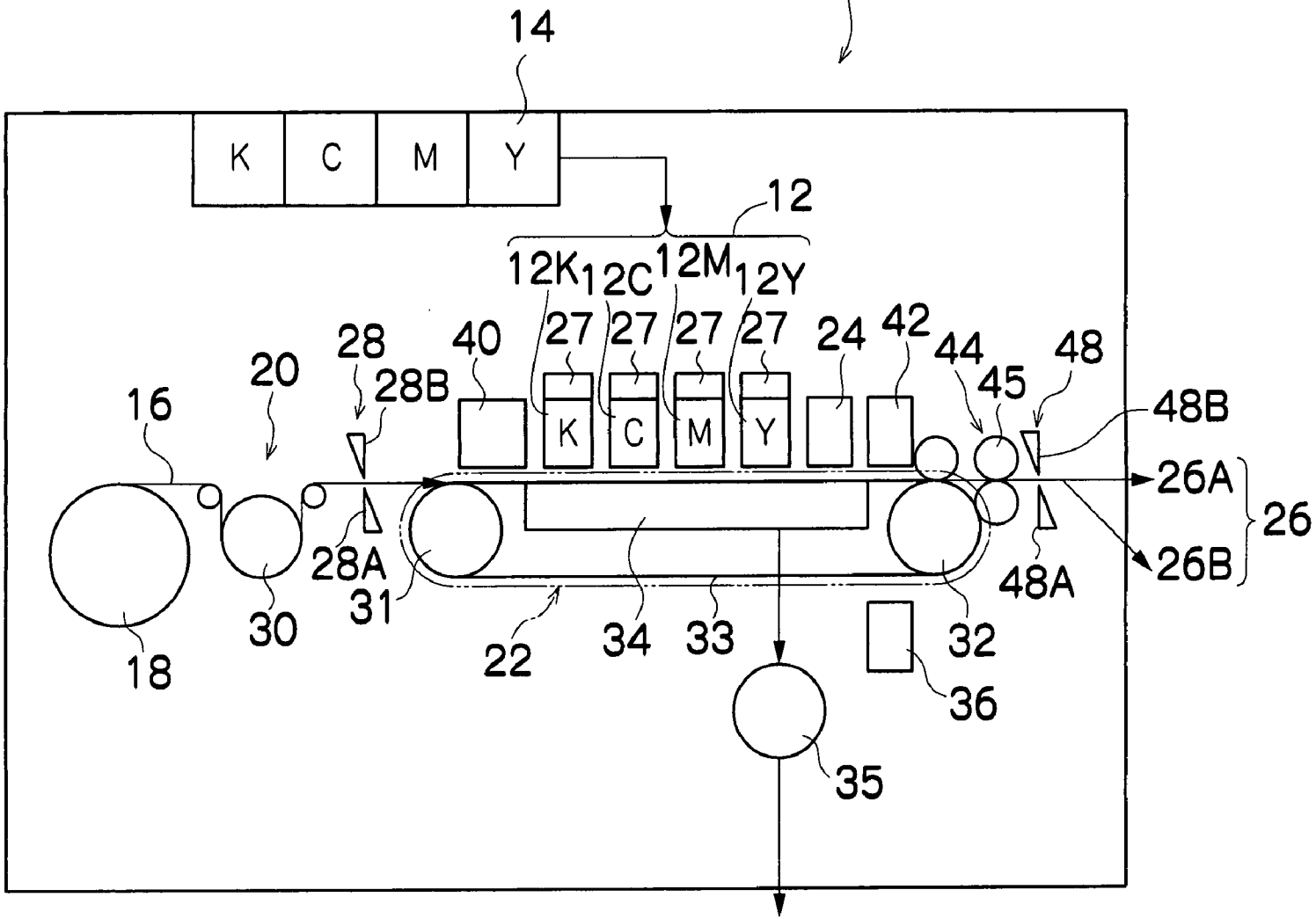
FIG. 1 is a general schematic drawing of an inkjet recording apparatus according to an embodiment of the present invention.

FIG. 1 is a general schematic drawing of an inkjet recording apparatus according to an embodiment of the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction.

The belt 33 is driven in the clockwise direction in FIG. 1 by the motive force of a motor (not shown in FIG. 1, but shown as a motor 88 in FIG. 7) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
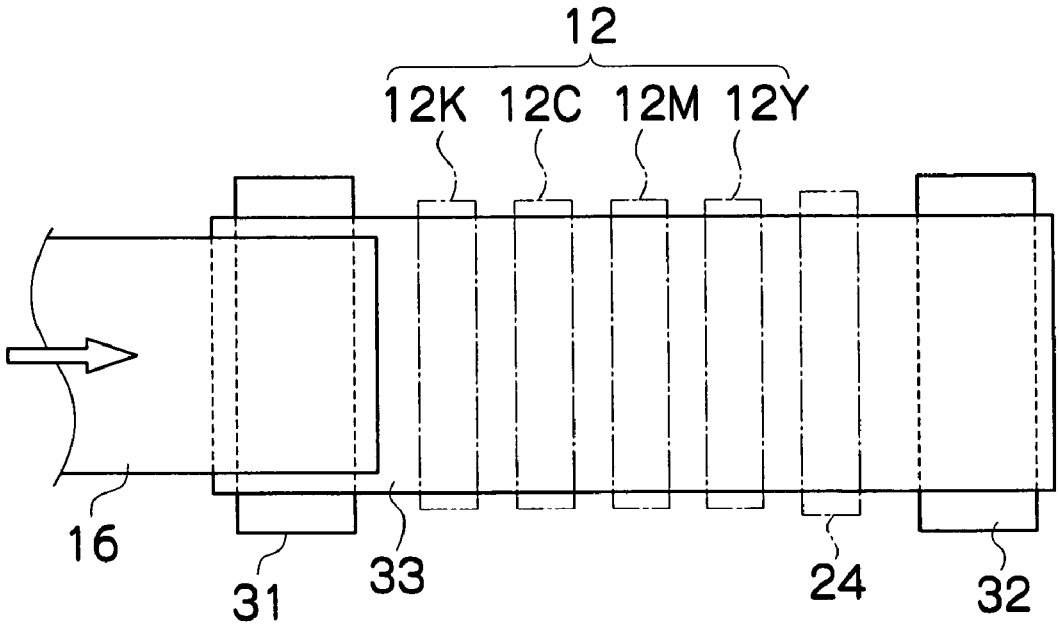
FIG. 2 is a plan view of principal components of an area around a printing unit of the inkjet recording apparatus in FIG. 1.

In the printing unit 12, each of the print heads 12K, 12C, 12M, and 12Y is composed of a full-line head in which has a length that corresponds to the maximum paper width intended for use in the inkjet recording apparatus 10, and in which a plurality of ink-droplet ejection apertures (nozzles) are arranged along a length that exceeds at least one side of the maximum-size recording paper 16 (i.e. along the entire width of printable area in the recording paper 16), as shown in FIG. 2.

The print heads 12K, 12C, 12M, and 12Y are arranged in this order from the upstream side along the paper conveyance direction. A color print can be formed on the recording paper 16 by ejecting the inks from the print heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

Although the configuration with the KCMY four standard colors is described in the present embodiment, combinations of the ink colors and the number of colors are not limited to those, and light and/or dark inks can be added as required. For example, a configuration is possible in which print heads for ejecting light-colored inks such as light cyan and light magenta are added. In addition, the order of arranging the print heads 12K, 12C, 12M, and 12Y is not limited to those.

As shown in FIG. 1, the ink storing and loading unit 14 has tanks for storing the inks of K, C, M and Y to be supplied to the print heads 12K, 12C, 12M, and 12Y, and the tanks are connected to the print heads 12K, 12C, 12M, and 12Y through channels (not shown), respectively. The ink storing and loading unit 14 has a warning device (e.g., a display device, an alarm sound generator) for warning when the remaining amount of any ink is low, and has a mechanism for preventing loading errors among the colors.

The print determination unit 24 has an image sensor for capturing an image of the ink-droplet deposition result of the print unit 12, and functions as a device to check for ejection defects such as clogs of the nozzles in the print unit 12 from the ink-droplet deposition results evaluated by the image sensor. The print determination unit 24 is configured with at least a line sensor or area sensor having rows of photoelectric transducing elements with a width that is greater than the ink-droplet ejection width (image recording width) of the print heads 12K, 12C, 12M, and 12Y.

The post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

The heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B. Although not shown in FIG. 1, the paper output unit 26A for the target prints is provided with a sorter for collecting prints according to print orders.

Structure of Print Head

Next, the structure of the print heads is described. The print heads 12K, 12C, 12M and 12Y have the same structure, and a reference numeral 50 is hereinafter designated to any of the print heads 12K, 12C, 12M and 12Y.

Figure 3A:
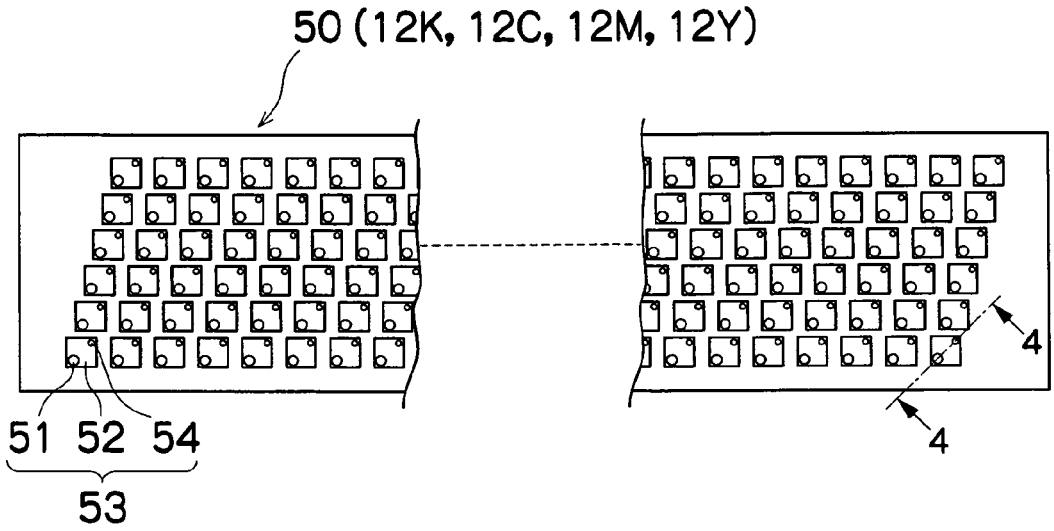
FIG. 3A is a perspective plan view showing an example of a configuration of a print head.
Figure 3B:
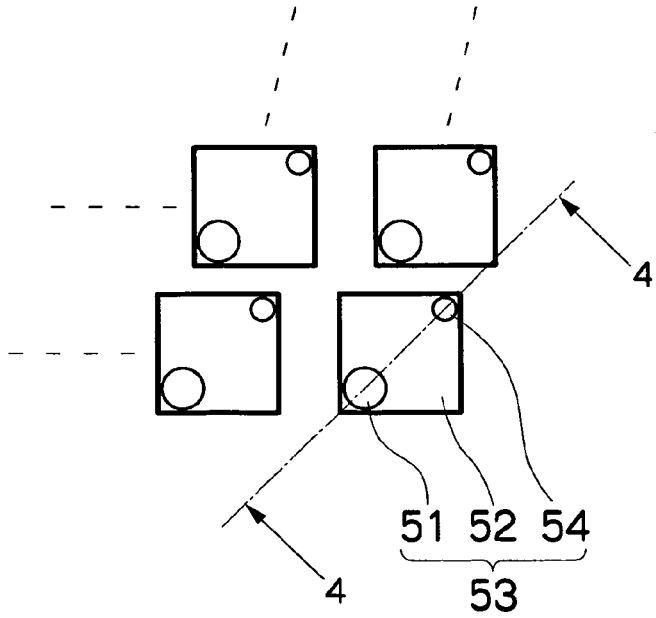
FIG. 3B is a partial enlarged view of FIG. 3A.
Figure 3C:
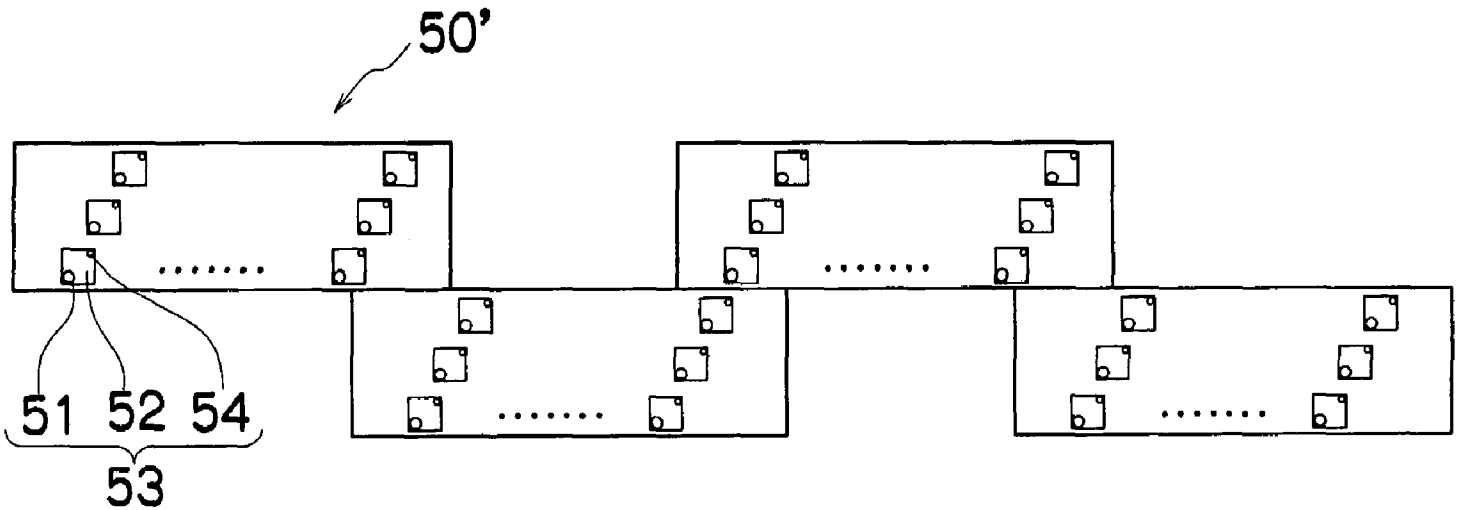
FIG. 3C is a perspective plan view showing another example of the configuration of the print head.
Figure 4:
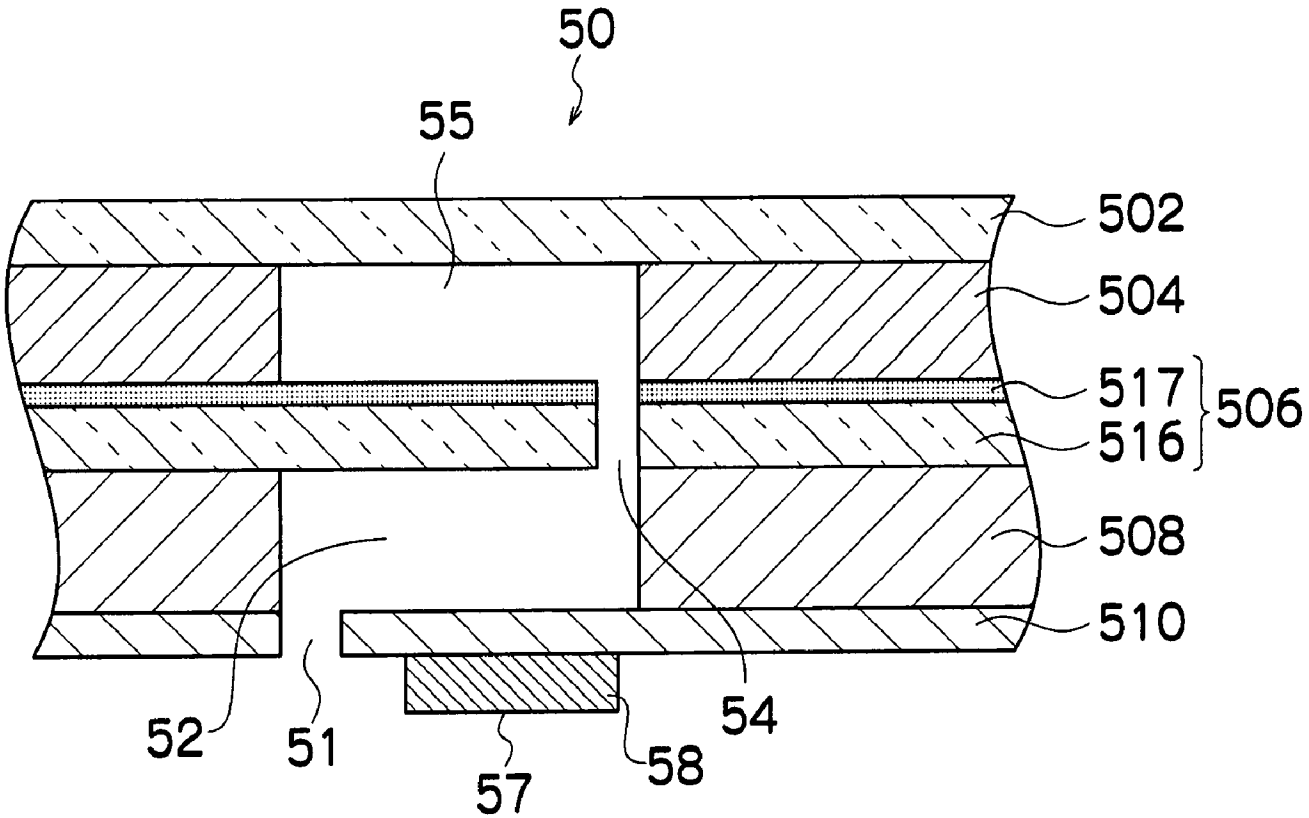
FIG. 4 is a cross-sectional view along a line 4-4 in FIGS. 3A and 3B.

FIG. 3A is a perspective plan view showing an example of the configuration of the print head 50, FIG. 3B is an enlarged view of a portion thereof, FIG. 3C is a perspective plan view showing another example of the configuration of the print head, and FIG. 4 is a cross-sectional view taken along the line 4-4 in FIGS. 3A and 3B, showing the inner structure of an ink chamber unit.

The nozzle pitch in the print head 50 should be minimized in order to maximize the density of the dots printed on the surface of the recording paper. As shown in FIGS. 3A, 3B, 3C and 4, the print head 50 in the present embodiment has a structure in which a plurality of ink chamber units 53 including nozzles 51 for ejecting ink-droplets and pressure chambers 52 connecting to the nozzles 51 are disposed in the form of a staggered matrix, and the effective nozzle pitch is thereby made small.

The print head 50 in the present embodiment is not limited to a full-line head in which one or more of nozzle rows in which the ink discharging nozzles 51 are arranged along a length corresponding to the entire width of the recording medium in the direction substantially perpendicular to the conveyance direction of the recording medium, as shown in FIG. 3A. Alternatively, as shown in FIG. 3C, a full-line head can be composed of a plurality of short two-dimensionally arrayed head units 50' arranged in the form of a staggered matrix and combined so as to form nozzle rows having lengths that correspond to the entire width of the recording paper 16.

As shown in FIGS. 3A and 3B, the planar shape of the pressure chamber 52 provided for each nozzle 51 is substantially a square, and the nozzle 51 and an inlet of supplied ink (supply port) 54 are disposed in both corners on a diagonal line of the square. The shape of the pressure chamber 52 is not limited to the present example, and the planar shape may one of various shapes, such as a quadrilateral shape (diamond, rectangle, or the like), another polygonal shape, such as a pentagon or hexagon, or a circular or elliptical shape.

As shown in FIG. 4, the head 50 is manufactured by laminating and bonding together a plurality of plate members (502 to 510), and has prescribed flow channels, such as a pressure chamber 52, a supply port 54, a common flow channel 55, and the like, formed inside same. More specifically, from the upper side in FIG. 4, a base plate 502, a common flow channel plate 504, a reflection plate 506, a pressure chamber plate 508 and a nozzle plate 510 are bonded together in this sequence.

The base plate 502 is a member constituting one face of the common flow channel 55 (the upper face in FIG. 4), and it is made of a material that transmits light (a transparent material). Provided that the material transmits light for observation purposes, it is not limited to being a colorless transparent material, and may also be a colored transparent material. It is sufficient that the regions required to inspect the interior of the head be made of a transparent material, but it is also possible to form the whole of the nozzle plate 502 for a transparent member.

The common flow channel plate 504 is a member forming side walls of the common flow channel 55. The reflection plate 506 has a structure in which a dielectric multi-layer film mirror 517 is vaporized onto a glass substrate 516. This reflection plate 506 is disposed between the common flow channel 55 and the pressure chamber 52, and the face on the side of the dielectric multi-layer film mirror 517 forms one face of the common flow channel 55 (the bottom face of the common flow channel in FIG. 4). Furthermore, the face of the glass substrate 516 on the opposite side forms one face of the pressure chamber 52 (the upper face of the pressure chamber in FIG. 4). Furthermore, the reflection plate 506 is a member that forms side walls of the flow channel corresponding to the supply port 54, which connects the pressure chamber 52 with the common flow channel 55.

The pressure chamber plate 508 is a member forming side walls of the pressure chamber 52. A nozzle 51 forming an ink discharge port is pierced in the nozzle plate 510. A "nozzle" is the final aperture portion from which liquid is discharged. This nozzle plate 510, as well as being a member forming one face of the pressure chamber 52 (the lower face in FIG. 4), also serves as a diaphragm (pressurization plate). An actuator 58 provided with an individual electrode 57 is bonded to the nozzle plate 510. The holes and grooves corresponding to the flow channels in the respective plate members (502 to 510) are formed by a commonly known shaping technique, such as etching, pressing, or the like.

As shown in the drawings, the head 50 according to this example has a structure in which the pressure chamber 52 and the common flow channel 55 are positioned in a layered structured in the direction of lamination (the vertical direction in FIG. 4), on either side of the reflection plate 506. The pressure chamber 52 is connected to the common flow channel 55 via a supply port 54.

Furthermore, the common flow channel 55 is connected to an ink tank (not shown in FIG. 4, but indicated by reference numeral 60 in FIG. 6), which is a base tank that supplies ink, and the ink supplied from the ink tank 60 is delivered through the common flow channel 55 in FIG. 4 to the pressure chambers 52.

When a drive voltage is applied to the individual electrode 57 corresponding to the actuator 58, then the actuator 58 deforms, thereby changing the volume of the pressure chamber 52. This causes a pressure change which results in ink being discharged from the nozzle 51. A piezoelectric body, such as a piezo element, is suitable as the actuator 58. When ink is discharged, new ink is supplied to the pressure chamber 52 from the common flow channel 55 through the supply port 54.

Figure 5:
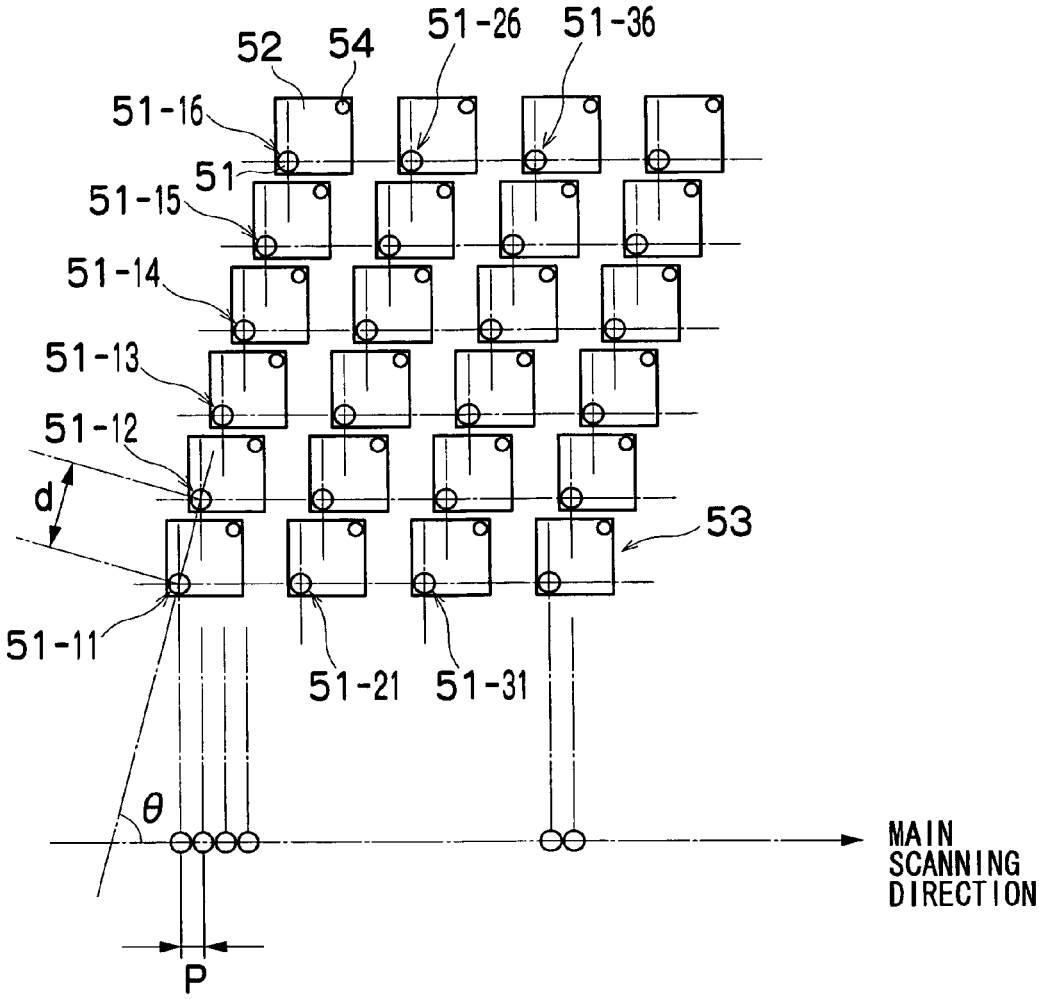
FIG. 5 is an enlarged view showing nozzle arrangement of the print head in FIG. 3A.

The plurality of ink chamber units 53 having such a structure are arranged in a grid with a fixed pattern in the line-printing direction along the main scanning direction and in the diagonal-row direction forming a fixed angle $\theta$ that is not a right angle with the main scanning direction, as shown in FIG. 5. With the structure in which the plurality of rows of ink chamber units 53 are arranged at a fixed pitch d in the direction at the angle $\theta$ with respect to the main scanning direction, the nozzle pitch P as projected in the main scanning direction is $d \times \cos\theta$.

Hence, the nozzles 51 can be regarded to be equivalent to those arranged at a fixed pitch P on a straight line along the main scanning direction. Such configuration results in a nozzle structure in which the nozzle row projected in the main scanning direction has a high nozzle density of up to 2,400 nozzles per inch (npi).

In a full-line head comprising rows of nozzles that have a length corresponding to the entire width of the paper (the recording paper 16), the "main scanning" is defined as to print one line (a line formed of a row of dots, or a line formed of a plurality of rows of dots) in the width direction of the recording paper (the direction perpendicular to the delivering direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block, . . . ); and one line is printed in the width direction of the recording paper 16 by sequentially driving the nozzles 51-11, 51-12, . . . , 51-16 in accordance with the conveyance velocity of the recording paper 16.

On the other hand, the "sub-scanning" is defined as to repeatedly perform printing of one line (a line formed of a row of dots, or a line formed of a plurality of rows of dots) formed by the main scanning, while moving the full-line head and the recording paper relatively to each other.

Therefore, "the main scanning direction" is the direction of one line (or the longitudinal direction of a band-shaped region) recorded by means of the aforementioned main scanning operation, and "the sub-scanning direction" is the direction in which the aforementioned sub-scanning operation. In other words, in the present embodiment, the direction of conveyance of the recording paper 16 is the sub-scanning direction and the direction orthogonal to this direction is the main scanning direction.

In implementing the present invention, the arrangement of the nozzles is not limited to that of the example illustrated. Moreover, a method is employed in the present embodiment where an ink droplet is ejected by means of the deformation of the actuator 59, which is typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure of these bubbles.

Configuration of Ink Supply System

Figure 6:
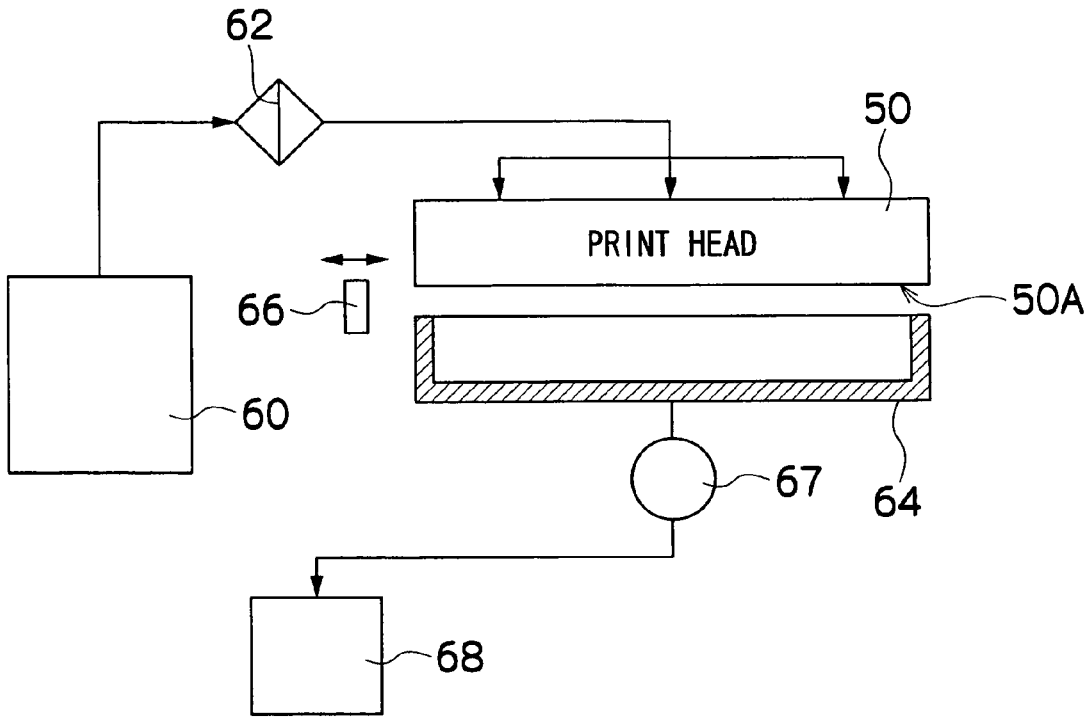
FIG. 6 is a schematic drawing showing a configuration of an ink supply system in the inkjet recording apparatus.

FIG. 6 is a schematic drawing showing the configuration of the ink supply system in the inkjet recording apparatus 10. An ink supply tank 60 is a base tank that supplies ink and is set in the ink storing and loading unit 14 described with reference to FIG. 1. The aspects of the ink supply tank 60 include a refillable type and a cartridge type: when the remaining amount of ink is low, the ink supply tank 60 of the refillable type is filled with ink through a filling port (not shown) and the ink supply tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink supply tank 60 in FIG. 6 is equivalent to the ink storing and loading unit 14 in FIG. 1 described above.

A filter 62 for removing foreign matters and bubbles is disposed between the ink supply tank 60 and the print head 50 as shown in FIG. 6. The filter mesh size in the filter 62 is preferably equivalent to or less than the diameter of the nozzle and commonly about 20 μm. Although not shown in FIG. 6, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 64 as a device to prevent the nozzles 51 from drying out or to prevent an increase in the ink viscosity in the vicinity of the nozzles 51, and a cleaning blade 66 as a device to clean the nozzle face. A maintenance unit including the cap 64 and the cleaning blade 66 can be moved in a relative fashion with respect to the print head 50 by a movement mechanism (not shown), and is moved from a predetermined holding position to a maintenance position below the print head 50 as required.

The cap 64 is displaced up and down in a relative fashion with respect to the print head 50 by an elevator mechanism (not shown). When the power of the inkjet recording apparatus 10 is switched OFF or when in a print standby state, the cap 64 is raised to a predetermined elevated position so as to come into close contact with the print head 50, and the nozzle face is thereby covered with the cap 64.

The cleaning blade 66 is composed of rubber or another elastic member, and can slide on the ink discharge surface (surface of the nozzle plate 510) of the print head 50 by means of a blade movement mechanism (not shown). When ink droplets or foreign matter has adhered to the nozzle plate 510, the surface of the nozzle plate 510 is wiped, and the surface of the nozzle plate 510 is cleaned by sliding the cleaning blade 66 on the nozzle plate 510.

During printing or standby, when the frequency of use of specific nozzles is reduced and ink viscosity increases in the vicinity of the nozzles, a preliminary discharge is made toward the cap 64 to discharge the degraded ink.

Also, when bubbles have become intermixed in the ink inside the print head 50 (inside the pressure chamber), the cap 64 is placed on the print head 50, ink (ink in which bubbles have become intermixed) inside the pressure chamber is removed by suction with a suction pump 67, and the suction-removed ink is sent to a collection tank 68. This suction action entails the suctioning of degraded ink whose viscosity has increased (hardened) when initially loaded into the head, or when service has started after a long period of being stopped.

When a state in which ink is not discharged from the print head 50 continues for a certain amount of time or longer, the ink solvent in the vicinity of the nozzles 51 evaporates and ink viscosity increases. In such a state, ink can no longer be discharged from the nozzle 51 even if the actuator 59 is operated. Before reaching such a state the actuator 59 is operated (in a viscosity range that allows discharge by the operation of the actuator 59), and the preliminary discharge is made toward the ink receptor to which the ink whose viscosity has increased in the vicinity of the nozzle is to be discharged. After the nozzle surface is cleaned by a wiper such as the cleaning blade 66 provided as the cleaning device for the nozzle face, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

When bubbles have become intermixed in the nozzle 51 or the pressure chamber 52, or when the ink viscosity inside the nozzle 51 has increased over a certain level, ink can no longer be discharged by the preliminary discharge, and a suctioning action is carried out as follows.

More specifically, when bubbles have become intermixed in the ink inside the nozzle 51 and the pressure chamber 52, ink can no longer be discharged from the nozzles even if the actuator 59 is operated. Also, when the ink viscosity inside the nozzle 51 has increased over a certain level, ink can no longer be discharged from the nozzle 51 even if the actuator 59 is operated. In these cases, a suctioning device to remove the ink inside the pressure chamber 52 by suction with a suction pump, or the like, is placed on the nozzle face of the print head 50, and the ink in which bubbles have become intermixed or the ink whose viscosity has increased is removed by suction.

However, this suction action is performed with respect to all the ink in the pressure chamber 52, so that the amount of ink consumption is considerable. Therefore, a preferred aspect is one in which a preliminary discharge is performed when the increase in the viscosity of the ink is small.

Figure 7:
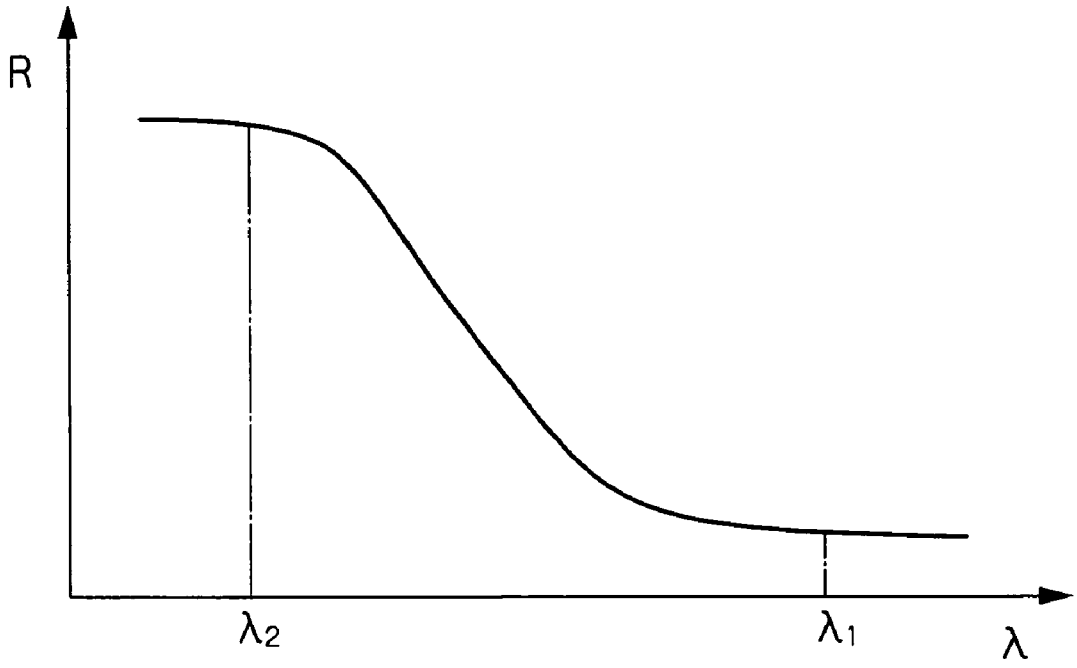
FIG. 7 is a graph showing an example of reflection characteristics of the dielectric multiple-layer film mirror illustrated in FIG. 4.

FIG. 7 is a graph showing an example of reflection characteristics of the dielectric multi-layer film mirror 517 described in FIG. 4. The horizontal axis in FIG. 7 indicates the wavelength of the incident light and the vertical axis indicates the reflectivity. As shown in FIG. 7, this dielectric multi-layer film mirror 517 changes reflectivity (transmissivity) with the wavelength of the incident light, having a high reflectivity in the relatively short wavelength region (the reflection wavelength range) and having an extremely low reflectivity in the wavelength region outside the reflection wavelength range (namely, the transmission wavelength range).

Figure 8A:
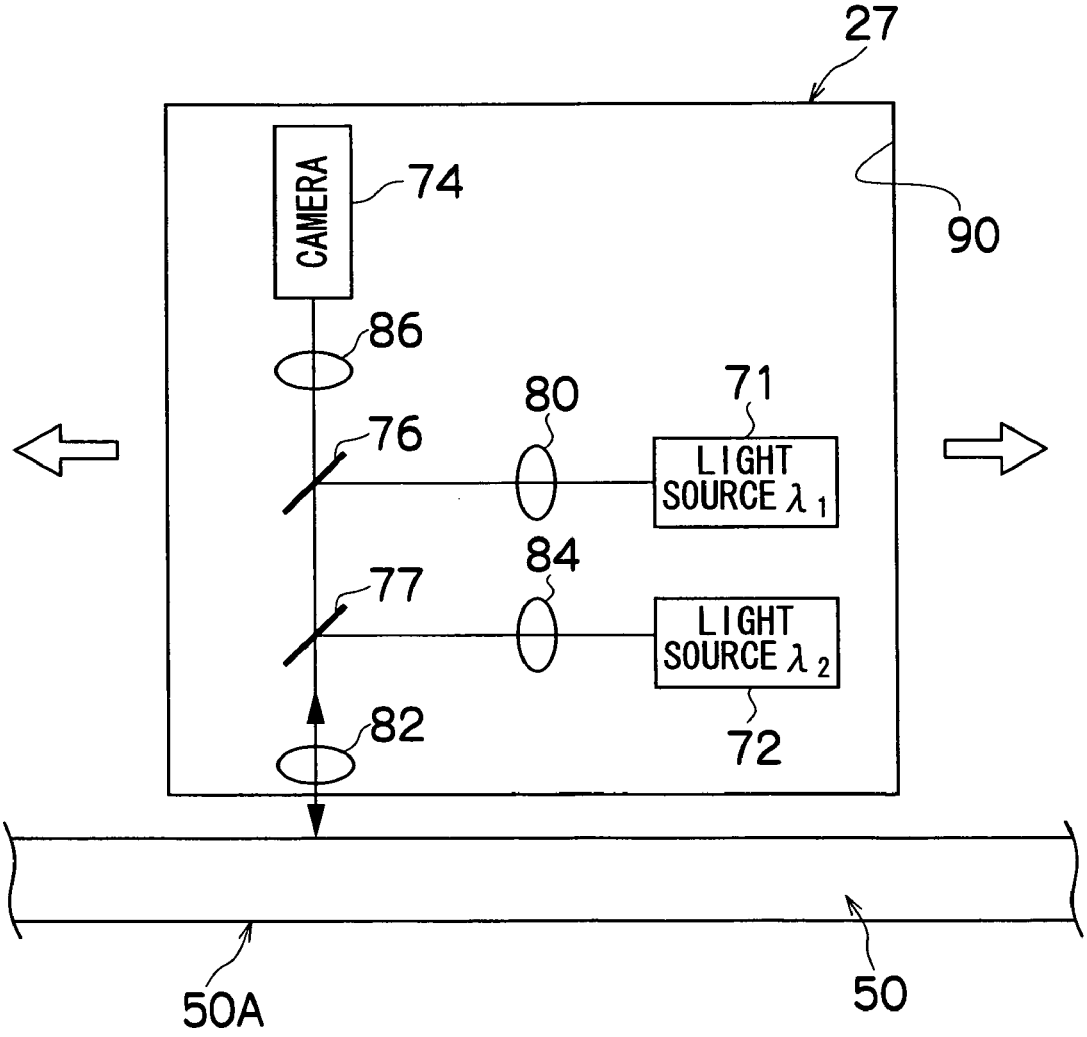
FIG. 8A is a diagram showing an example of a configuration of an observation unit.

FIG. 8A is a compositional diagram of an observation unit 27. As shown in FIG. 8A, the observation unit 27 comprises a first light source 71, a second light source 72, a camera 74, half-mirrors 76, 77, and lenses 80 to 86. The optical system formed by these elements is accommodated inside a casing 90.

The central wavelength λ1 of the light irradiated from the first light source 71 comes within the transmission wavelength range illustrated in FIG. 7, and the central wavelength λ2 of the light irradiated from the second light source 72 comes within the reflection wavelength range illustrated in FIG. 7. The first light source 71 and the second light source 72 may be constituted by a light emitting element, such as a light-emitting diode (LED), a laser diode (LD), or the like.

As shown in FIG. 8A, the light emitted from the first light source 71 is input to the half-mirror 76 via the lens 80, and is reflected downwards in FIG. 8A by the half-mirror 76, and irradiated onto the print head 50 via the lens 82. Similarly, the light emitted from the second light source 72 is input to the half-mirror 77 via the lens 84, and is irradiated onto the print head 50 via the half-mirror 77 and the lens 82.

By controlling the light emission by the first light source 71 or the second light source 72, the light from the respective light sources is irradiated selectively onto the print head 50.

The light reflected by the print head 50 is input to the observation unit 27 via the lens 82, and it passes straight through the half-mirrors 77 and 76, and enters into the camera 74 via the lens 86. The camera 74 is an electronic imaging device comprising an imaging element, such as a CCD image sensor, a CMOS image sensor, or the like. The camera 74 according to the present example is equipped with an area sensor in which a plurality of photosensors are arranged in a two-dimensional configuration. The optical image focussed onto the light-receiving face of the imaging element by the lens 86 is converted by the photosensors into an electrical signal corresponding to the intensity of the incident light, and is output from the camera 74 as an image signal.

The observation unit 27 is supported movably via a movement mechanism (not illustrated) on the rear surface of the head 50 (the side opposite to the nozzle surface 50A), and can thus perform a scanning movement in such a manner that all of the pressure chambers 52 of the print head 50 can be observed.

By obtaining image data via the camera 74 and performing calculations (such as image processing) on the basis of the image data thus obtained, it is possible to determine the presence or absence of foreign matter, and the position of same.

FIG. 8A shows a basic, simple composition of an optical system, but it is possible to adopt various designs for the optical system, by using mirrors, prisms, optical fibers, or other optical elements (not illustrated). Furthermore, instead of the camera 74 equipped with an area sensor, it is also possible to use another type of light-receiving element, such as a line sensor.

In FIG. 8A, one camera 74 is used as a light receiving device, but it is possible to improve the determination accuracy by providing a plurality of light receiving devices (for example, a plurality of cameras) having different peak sensitivities, in accordance with the wavelength range of the determination light. Furthermore, it is also possible to adopt a composition in which a common light source is used, by adopting a plurality of light receiving devices having different peak sensitivities.

Figure 8B:
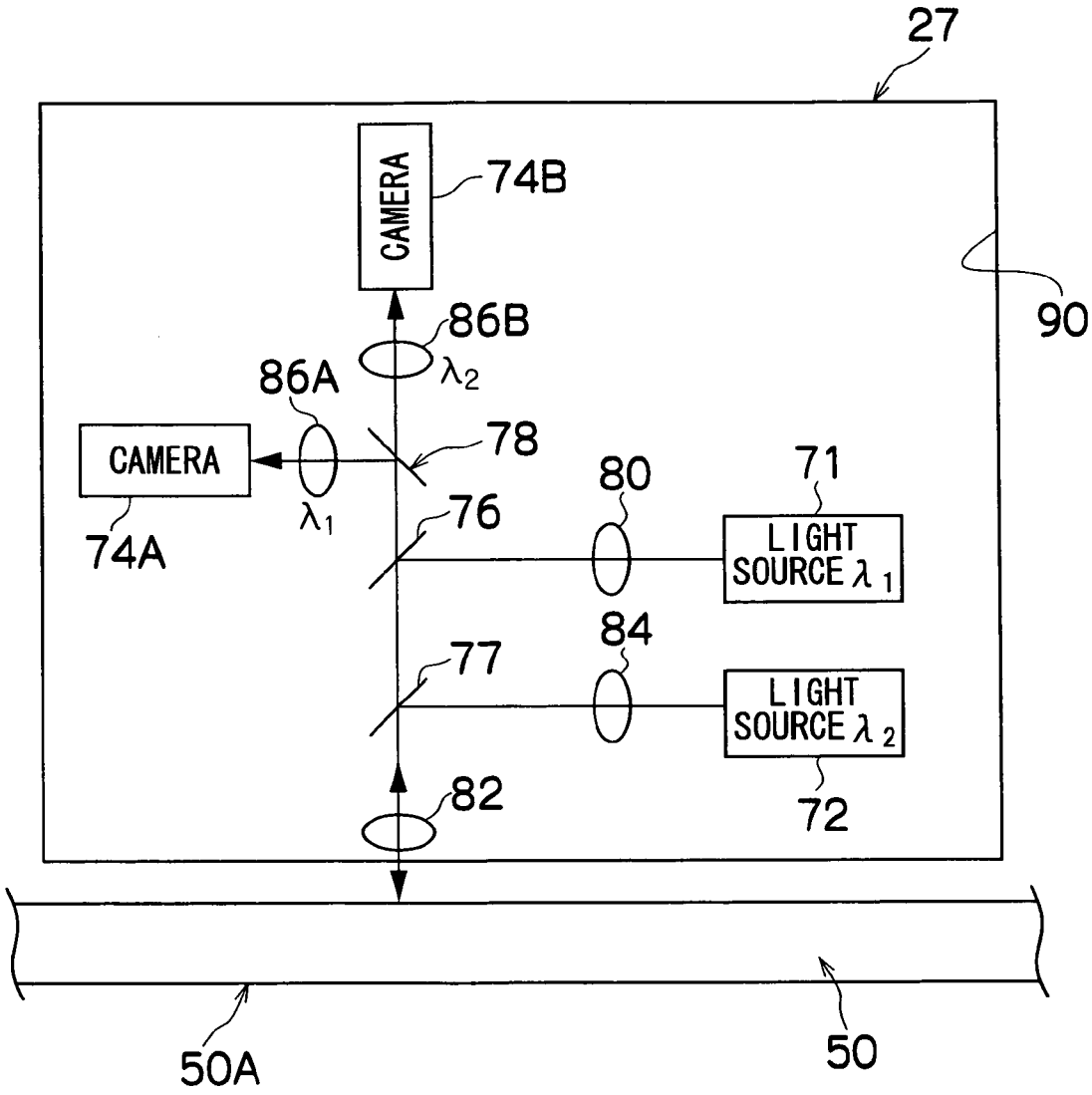
FIG. 8B is a diagram showing an example of the configuration of an observation unit using two cameras.

FIG. 8B is a diagram showing an example of the composition of an observation unit using two cameras. In this diagram, parts which are the same or similar to the example shown in FIG. 8A are labeled with the same reference numerals and further description thereof is omitted.

The observation unit 27 shown in FIG. 8B comprises a dichroic mirror 78, two cameras 74A and 74B, and lenses 86A and 86B for directing the light to the cameras 74A and 74B.

The dichroic mirror 78 is an optical member which selectively reflects or transmits light of a particular wavelength only. In the present example, it reflects light of wavelength λ1 and transmits light of wavelength λ2. More specifically, the reflected light from the head 50 is divided by the dichroic mirror 78 into light of a wavelength range containing wavelength λ1 and light of a wavelength range containing wavelength λ2. The light of the wavelength λ1 reflected by the dichroic mirror 78 is input to the camera 74A via the lens 86A. Furthermore, the light of wavelength λ2 transmitted by the dichroic mirror 78 is input to the camera 74B via the lens 86B.

Figure 8C:
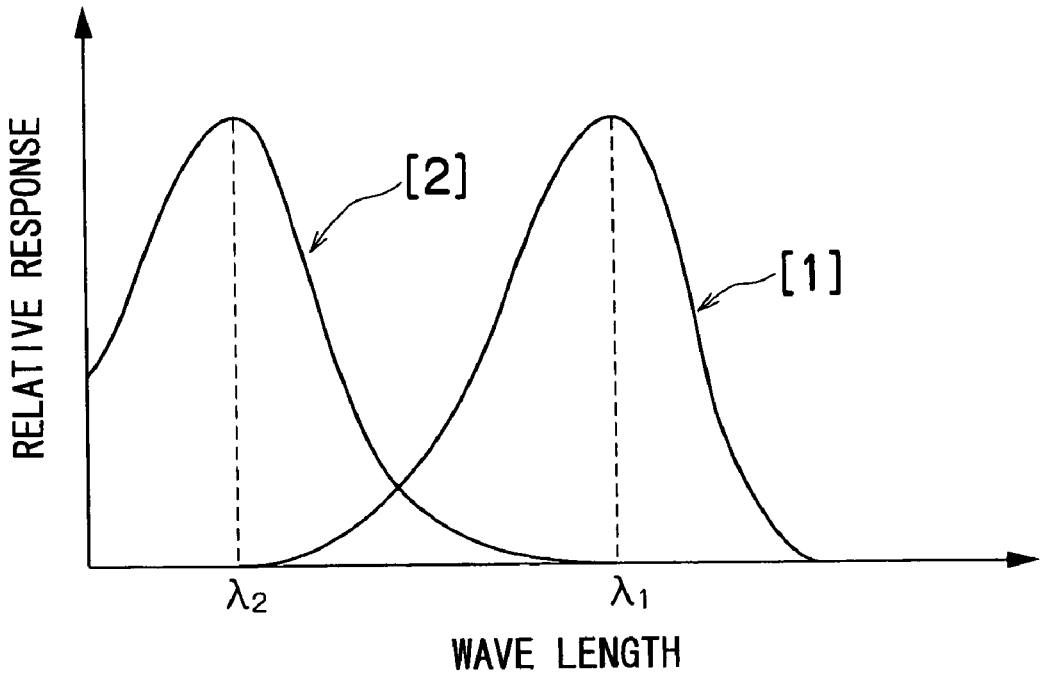
FIG. 8C is a graph showing an example of the spectral sensitivity of a camera.

FIG. 8C is a graph showing an example of the spectral sensitivity of the camera. The horizontal axis indicates wavelength and the vertical axis indicates relative sensitivity. Curve (1) in FIG. 8C shows the spectral characteristics of the camera 74A illustrated in FIG. 8B, which has a peak sensitivity in the vicinity of wavelength λ1. On the other hand, curve (2) in FIG. 8C shows the spectral characteristics of the camera 74B illustrated in FIG. 8B, which has a peak sensitivity in the vicinity of wavelength λ2.

In this way, it is possible to achieve even higher determination accuracy by using cameras 74A and 74B having spectral sensitivities that match the wavelength ranges of the determination light.

Figure 8D:
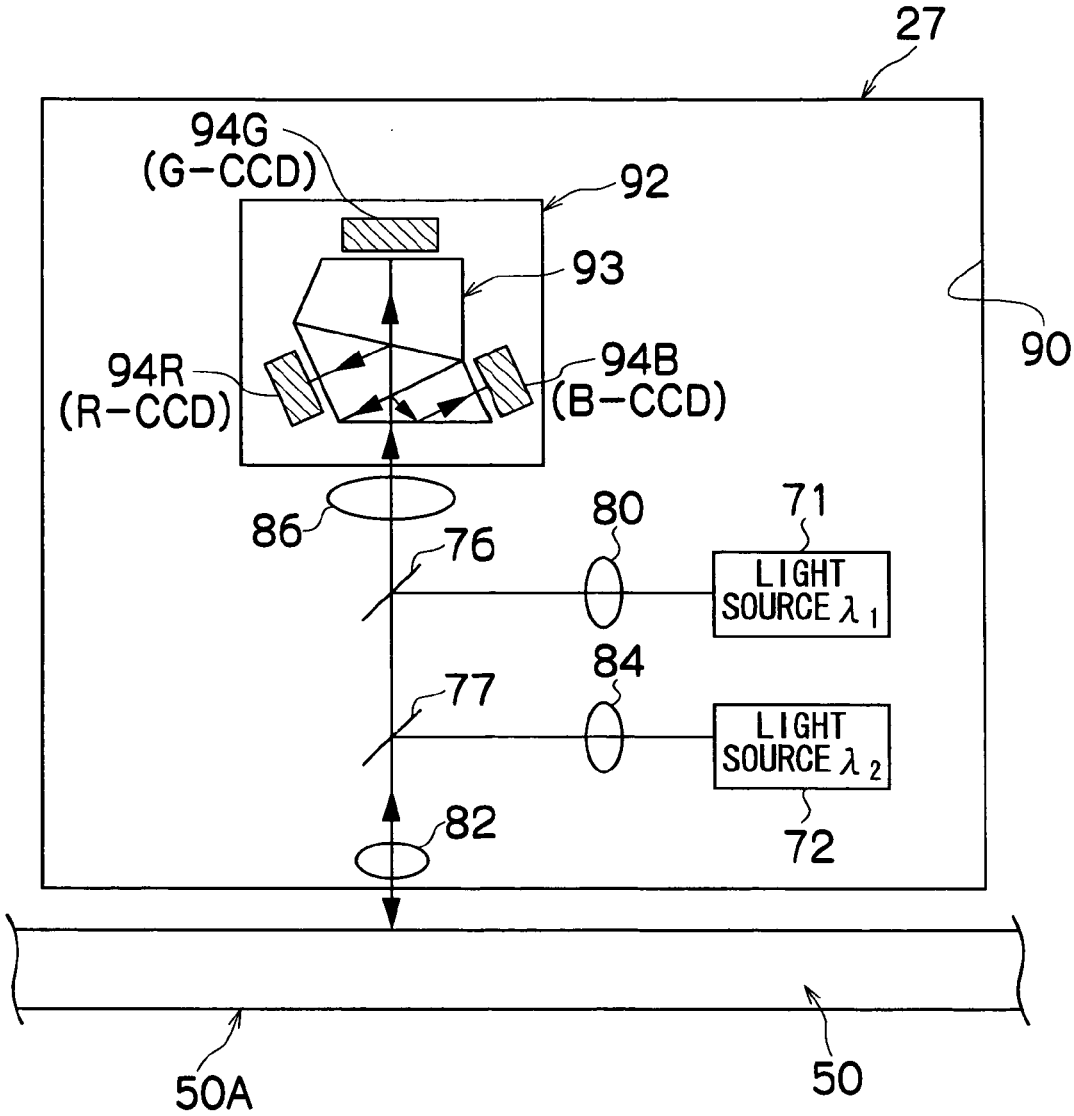
FIG. 8D is a diagram showing a further example of the configuration of an observation unit.

FIG. 8D is a diagram showing yet a further compositional example of an observation unit. In this diagram, parts which are the same or similar to the example illustrated in FIG. 8A are labeled with the same reference numerals and further description thereof is omitted here.

The observation unit 27 shown in FIG. 8D uses a three-plate system (3 CCD system) camera (hereafter, called "3-CCD camera" and labeled with reference numeral 92). The 3-CCD camera 92 is constituted by a color-splitting prism 93, and three CCDs (imaging elements) 94R, 94G and 94B.

The light incident via the lens 86 is split into the three primary colors (red, green and blue (R, G, B)) by the color-splitting prism 93, and the split light is received by the CCDs 94R, 94G and 94B disposed facing the respective R, G and B emission faces of the color-splitting prism 93. A mode using a 3-CCD camera 92 allows image information to be obtained with a higher level of reproducibility compared to a mode where a single-plate type camera is used.

The relationship between the spectral characteristics of the 3-CCD camera 92 and the wavelengths λ1 and λ2 is not limited in particular, but desirably, the wavelengths λ1 and λ2 are set respectively in the vicinity of the peak spectral sensitivity wavelengths of the CCDs 94R, 94G and 94B.

For example, the wavelength λ1 is set in the vicinity of the wavelength at which the red CCD 94R has peak spectral sensitivity, while the wavelength λ2 is set in the vicinity of the wavelength at which the blue CCD 94B has peak spectral sensitivity. By adopting a composition in which the light of wavelengths λ1 and λ2 is received respectively by different CCDs in this way, it is possible to determine the light of the respective wavelength ranges, with a high level of sensitivity.

Description of Control System

Figure 9:
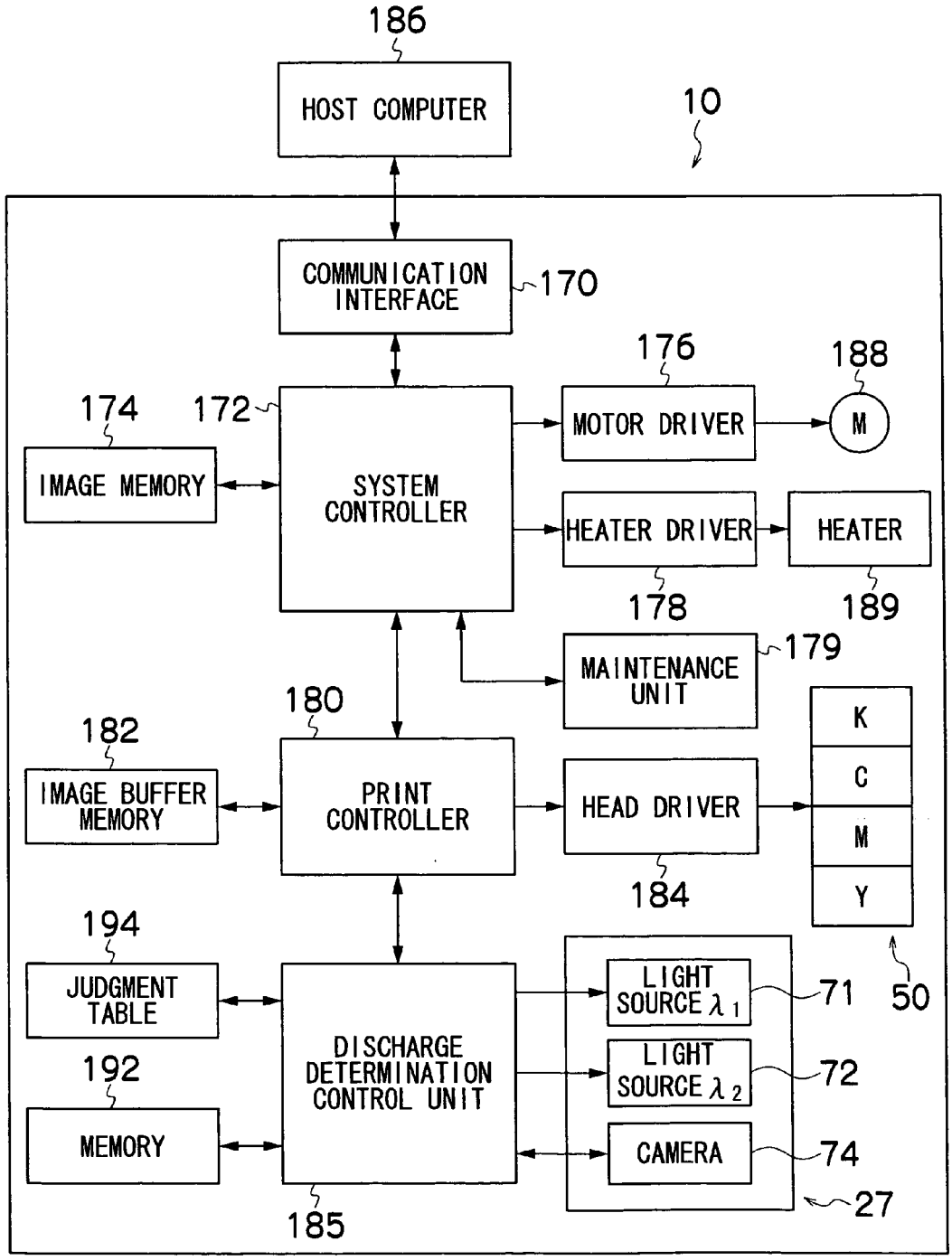
FIG. 9 is a principal block diagram showing the system composition of the inkjet recording apparatus.

Next, a control system of the inkjet recording apparatus 10 is described. FIG. 9 is a block diagram of the principal components showing the system configuration of the inkjet recording apparatus 10. The inkjet recording apparatus 10 has a communication interface 170, a system controller 172, an image memory 174, a motor driver 176, a heater driver 178, a maintenance unit 179, a print controller 180, an image buffer memory 182, a head driver 184, a discharge determination control unit 185, and other components.

The communication interface 170 is an interface unit for receiving image data sent from a host computer 186. A serial interface such as USB, IEEE1394, Ethernet, wireless network, or a parallel interface such as a Centronics interface may be used as the communication interface 170. A buffer memory (not shown) may be mounted in this portion in order to increase the communication speed.

The image data sent from the host computer 186 is received by the inkjet recording apparatus 10 through the communication interface 170, and is temporarily stored in the image memory 174. The image memory 174 is a storage device for temporarily storing images inputted through the communication interface 170, and data is written and read to and from the image memory 174 through the system controller 172. The image memory 174 is not limited to memory composed of a semiconductor element, and a hard disk drive or another magnetic medium may be used.

The system controller 172 controls the communication interface 170, image memory 174, motor driver 176, heater driver 178, and other components. The system controller 172 has a central processing unit (CPU), peripheral circuits therefor, and the like. The system controller 172 controls communication between itself and the host computer 186, controls reading and writing from and to the image memory 174, and performs other functions, and also generates control signals for controlling a heater 189 and the motor 188 in the conveyance system.

The motor driver (drive circuit) 176 drives the motor 188 in accordance with commands from the system controller 172. The heater driver (drive circuit) 178 drives the heater 189 of the post-drying unit 42 or the like in accordance with commands from the system controller 172.

The maintenance unit 179 is a block which includes the cap 64 and the cleaning blade 66 shown in FIG. 6, so as to perform the required recovery operation in accordance with commands from the system controller 172.

The print controller 180 has a signal processing function for performing various tasks, compensations, and other types of processing for generating print control signals from the image data stored in the image memory 174 in accordance with commands from the system controller 172 so as to apply the generated print control signals (image formation data) to the head driver 184. Prescribed signal processing is carried out in the print control unit 180, and the discharge amount and the discharge timing of the ink droplets from the respective print heads 50 are controlled via the head drier 184, on the basis of the image data. By this means, prescribed dot size and dot positions can be achieved.

The print controller 180 is provided with the image buffer memory 182; and image data, parameters, and other data are temporarily stored in the image buffer memory 182 when image data is processed in the print controller 180. The aspect shown in FIG. 9 is one in which the image buffer memory 182 accompanies the print controller 180; however, the image memory 174 may also serve as the image buffer memory 182. Also possible is an aspect in which the print controller 180 and the system controller 172 are integrated to form a single processor.

The head driver 184 drives the actuators 58 which drive discharge in the respective color heads 50, on the basis of the print data supplied from the print controller 180. A feedback control system for maintaining constant drive conditions for the print heads may be included in the head driver 184.

The image data to be printed is externally inputted through the communications interface 170, and is stored in the image memory 174. At this stage, RGB image data is stored in the image memory 174, for example. The image data stored in the image memory 174 is sent to the print controller 180 through the system controller 172, and is converted to the dot data for each ink color by a known dithering algorithm, random dithering algorithm or another technique in the print controller 180.

The print head 50 is driven on the basis of the dot data thus generated by the print controller 180, so that ink is discharged from the head 50. By controlling ink discharge from the heads 50 in synchronization with the conveyance speed of the recording paper 16, an image is formed on the recording paper 16.

The discharge determination control unit 185 is constituted by a light source control circuit which controls the on and off switching and the emitted light intensity of the first light source 71 and the second light source 72 of the observation unit 27, and a signal processing circuit for processing an image signal (determination signal) obtained from the camera 74. The discharge determination control unit 185 controls light emission by the first light source 71 and the second light source 72 in accordance with instructions from the print controller 180, as well as processing the image data obtained from the camera 74.

The discharge determination control unit 185 is connected to a memory 192 which stores image data obtained from the camera 74 and a judgment table storage section 194 which stores table data used to judge discharge failures. The judgment table storage section 194 according to the present example stores table data indicating the relationship between the position and size of foreign matter (air bubbles), and the risk of discharge failure. The discharge determination control unit 185 evaluates the risk of a discharge failure occurring, by referring to the information obtained from the memory 192 and the aforementioned table data, and it supplies the evaluation result to the print controller 180.

The print controller 180 and the system controller 172 implement control in order that a prescribed restoration operation is carried out when the risk of a discharge failure is judged to be high on the basis of the information obtained from the discharge determination control unit 185.

Next, the operation of the inkjet recording apparatus 10 having the foregoing composition will be described.

FIG. 10 is a flowchart showing an example of a sequence of discharge determination in the inkjet recording apparatus 10. Here, an example is shown in which the determination operation is started on the basis of a timer which controls the determination timing, but various designs are possible for deciding the timing at which a determination operation is to be implemented. Besides time-based management by a timer as shown in FIG. 10, the determination operation may also be started on the basis of the number of sheets printed, the amount of ink consumed, or a combination of these factors.

In FIG. 10, when a determination operation is started under the time management of the timer (step S110), firstly, the first light source 71 of the observation unit 27 is lighted up (step S112), and the interior of the head 50 is observed by means of the camera 74 (step S114). Since light of wavelength λ1 irradiated by the first light source 71 is transmitted through the reflection plate 506, the camera 74 is able to observe the interior of both the pressure chamber 52 and the common flow channel 55, simultaneously. In this case, the image data obtained by the camera 74 (hereafter, called "the first foreign matter information") is stored in the memory 192 (step S116).

When the first foreign matter information is obtained, the first light source 71 is switched off (step S118), and the second light source 72 is lighted up (step S120). The light of wavelength λ2 irradiated by the second light source 72 is reflected by the reflection plate 506 and hence does not reach the pressure chamber 52. Therefore, the camera 74 is only able to observe the interior of the common flow channel 55. In this case, the image data obtained by the camera 74 (hereafter, called "the second foreign matter information") is stored in the memory 192 (step S124).

When this second foreign matter information has been obtained, the second light source 72 is switched off (step S126), and the respective foreign matter information are calculated for the pressure chamber 52 and the common flow channel 55 on the basis of the information in the memory 192 (step S128).

It is then judged whether or not foreign matter is present inside the pressure chamber 52, on the basis of the calculation results of the step S128 (step S130). This judgment process is carried out with reference to the judgment table which indicates the relationship between the size of the foreign matter inside the pressure chamber, and the risk of discharge failure.

At step S130, if it is judged that foreign matter is present inside the pressure chamber 52, then a restoration operation (for example, suctioning) is carried out (step S132), thereby removing the foreign matter from the print head 50. In this case, by carrying out a restoration operation in respect of individual head units (head blocks) in the case of the head composition shown in FIG. 3C, it is possible to achieve an efficient restoration operation (the same applies to step S138 described below).

On the other hand, if it is judged that there is no foreign matter at step S130, then the procedure advances to step S134 and the presence of foreign matter inside the common flow channel 55 is judged.

More specifically, at step S134, it is judged whether or not foreign matter is present inside the common flow channel 55, on the basis of the calculation result obtained at step S128. This judgment process is carried out with reference to the judgment table which indicates the relationship between the position and size of the foreign matter inside the common flow channel, and the risk of discharge failure.

If foreign matter is present inside the common flow channel 55, this does not mean that a discharge error will ensue immediately, but the probability (risk) of a discharge failure increases, depending on the position and size of the foreign matter. Therefore, the risk is evaluated by using a previously prepared judgment table.

At step S134, if a judgment is obtained that indicates the present of foreign matter inside the common flow channel 55, then the procedure advances to step S136, and it is judged whether or not it is necessary to carry out a restoration operation straight away. This judgment process is also made on the basis of a judgment table which indicates the relationship between the position and size of the foreign matter, and the risk of discharge failure.

If it is judged that there is a high possibility of a discharge failure occurring immediately, in other words, if the foreign matter is located very near to the pressure chamber 52, for instance, then a restoration operation is implemented (step S138). On the other hand, if it is judged at step S136 that a discharge failure will not ensue immediately, then the internal observation of the common flow channel 55 only is continued (step S140), and the procedure then returns to step S134. In this way, by performing a tracking observation of foreign matter inside the common flow channel 55, it is possible to know that foreign matter may enter into the pressure chamber 52, before it actually enters. Thereupon, if it is judged that a restoration operation is required at step S136, during this tracking observation, then a restoration operation is implemented. In this way, it is possible to perform a restoration operation effectively, before a discharge error occurs due to the presence of foreign matter.

On the other hand, if the foreign matter breaks up during the tracking observation, or if there is no foreign matter from the start, then it is judged at step S134 that no foreign matter is present inside the common flow channel 55 and the determination operation ends (step S142).

Further Embodiments

Next, a further embodiment of the present invention will be described.

Figure 11:
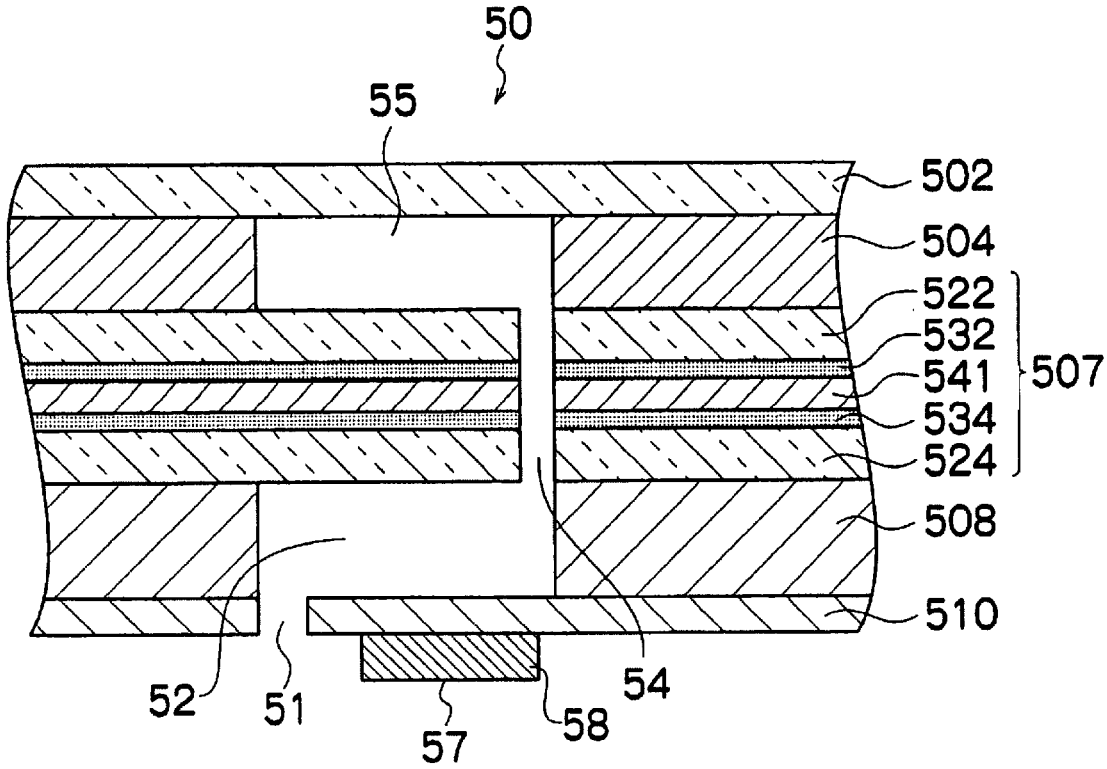
FIG. 11 is a cross-sectional diagram showing an example of the composition of a print head relating to a further embodiment of the present invention.

FIG. 11 is a cross-sectional diagram showing an example of the composition of a print head relating to a further embodiment of the present invention. In this diagram, items which are the same as or similar to those in FIG. 4 are labeled with the same reference numerals and description thereof is omitted here.

The print head 50 shown in FIG. 11 has a structure in which a reflection control plate 507 made of a cholesteric liquid crystal is provided between the pressure chamber 52 and the common flow channel 55, instead of the reflection plate 506 shown in FIG. 4.

This reflection control plate 507 has a laminated structure in which a liquid crystal layer 541 is held between two glass substrates 522 and 524, via transparent electrodes 532 and 534. The liquid crystal layer 541 sealed between the transparent electrodes 532, 534 changes its molecular arrangement in accordance with voltage applied between the transparent electrodes 532 and 534, and switches between reflection and transmission of circularly polarized light.

Figures 12A, 12B:
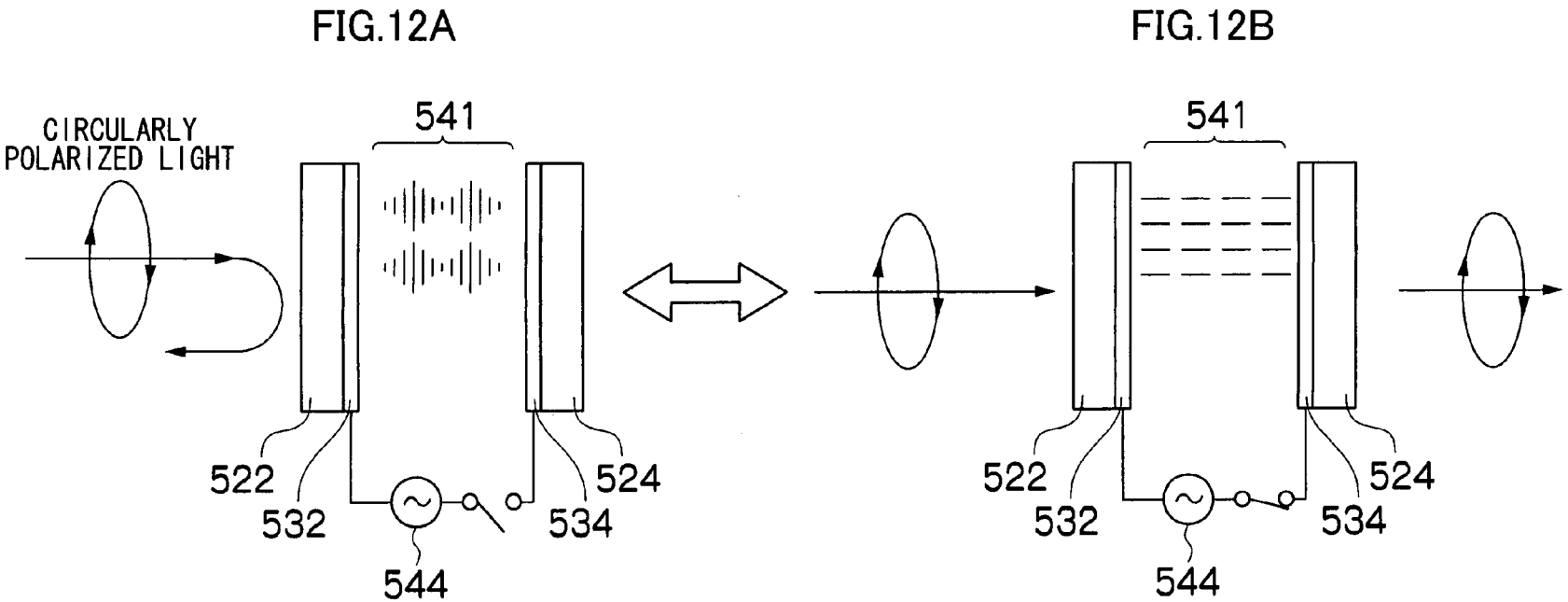
FIGS. 12A and 12B are schematic drawings for the purpose of describing the characteristics of a cholesteric liquid crystal.

FIGS. 12A and 12B is a schematic drawing showing the characteristics of a cholesteric liquid crystal. In FIGS. 12A and 12B, numeral 544 denotes a voltage source. As shown in FIG. 12A, if no voltage is applied between the transparent electrodes 532 and 534, the molecular arrangement of the liquid crystal layer 541 has a spiral structure and circular polarized incident light is reflected. On the other hand, if a voltage is applied between the transparent electrodes 532 and 534 as shown in FIG. 12B, then the molecules line up with the electrical field, and the circular polarized incident light is transmitted.

Figure 13:
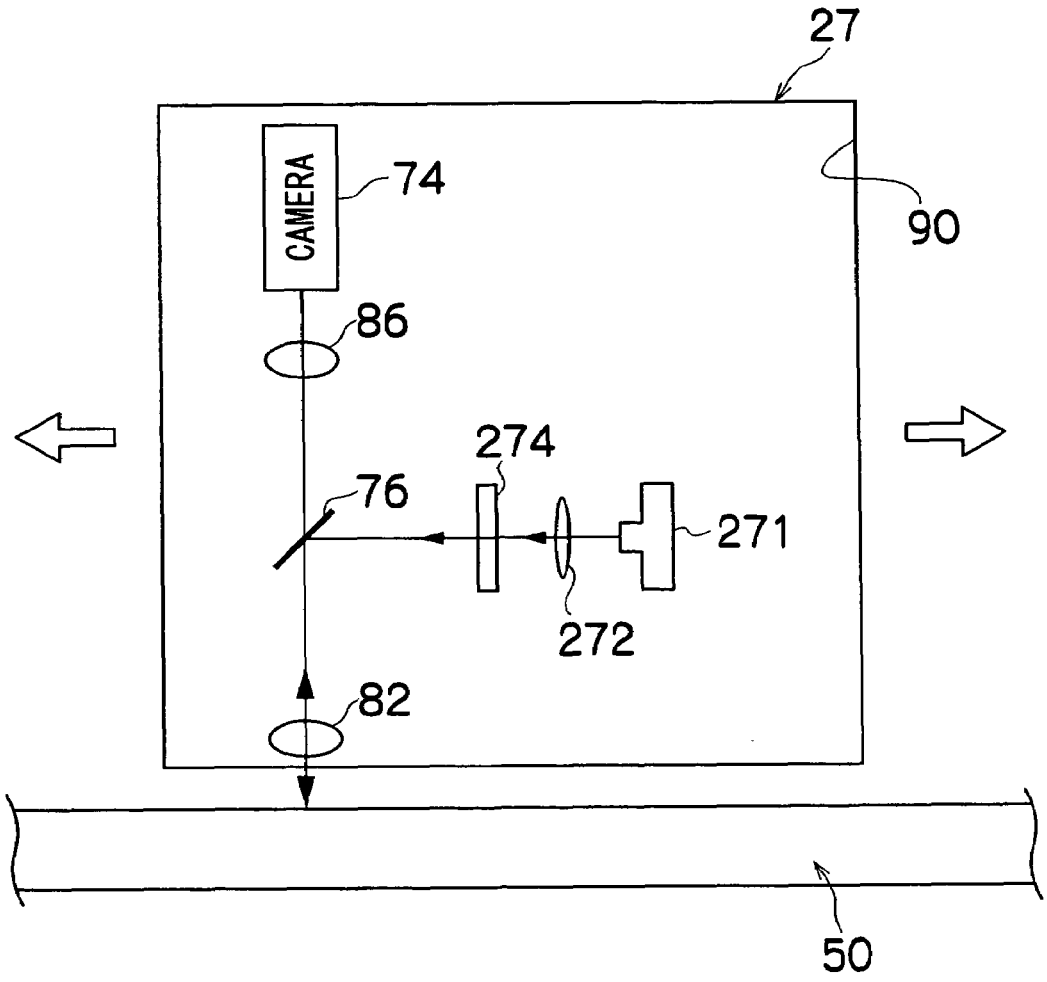
FIG. 13 is a diagram showing an example of the configuration of an observation unit used in a head having the composition shown in FIG. 11, and FIGS. 12A and 12B.

FIG. 13 is a diagram showing an example of the composition of an observation unit 27 used as an internal flow channel observation device for a print head 50 composed as shown in FIG. 11, and FIGS. 12A and 12B. In FIG. 13, items which are the same as or similar to those in FIG. 8A are labeled with the same reference numerals and description thereof is omitted here.

The observation unit 27 illustrated in FIG. 13 is constituted by a laser light source 271, a lens 272 and a λ/4 plate. A light emitting element, such as a laser diode (LD), or the like, is suitable for use as a laser light source 271.

The linearly polarized light emitted by the laser light source 271 passes through the lens 272 and is input to the λ/4 plate 274, which transmits the light and converts it into circularly polarized light. This light is irradiated onto the print head 50 via the half-mirror 76 and the lens 82.

Furthermore, the light reflected by the print head 50 is input to the observation unit 27 via the lens 82, and it passes straight through the half-mirror 76, and enters into the camera 74 via the lens 86.

As illustrated in FIG. 11, and FIGS. 12A and 12B, by controlling the molecular arrangement of the liquid crystal layer 541 inside the print head 50 and thus switching the reflection control plate 507 between reflection and transmission, it is possible to observe the pressure chamber 52 and the common flow channel 55, in a selective fashion.

Figure 14:
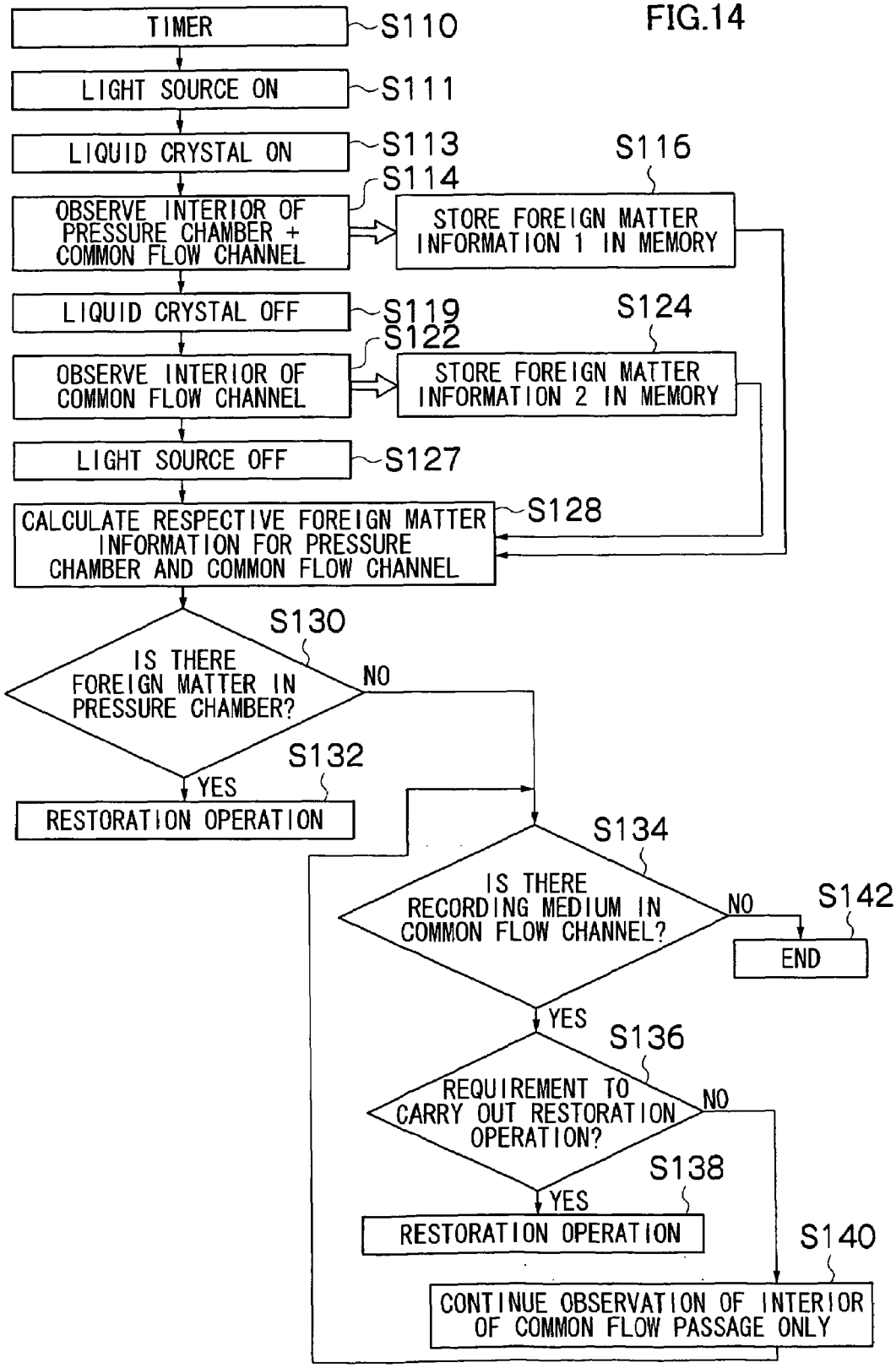
FIG. 14 is a flowchart showing an example of a sequence for determining discharge in an inkjet recording apparatus having the composition shown in FIG. 11 to FIG. 13.

An example of a sequence performed in the compositional example illustrated in FIGS. 11 to 13 is illustrated in FIG. 14. In the flowchart in FIG. 14, steps that are common to those in FIG. 14 and FIG. 10 are labeled with the same step numbers and further description thereof is omitted here.

In the flowchart shown in FIG. 14, the liquid crystal layer 541 is switched on and off, instead of selectively switching a first light source 71 and a second light source 72 on and off, as illustrated in FIG. 10. In other words, after starting a determination operation on the basis of the time management performed by the timer (step S110), the laser light source 271 is lighted up (step S111), and a voltage is applied between the transparent electrodes 532 and 534 of the reflection control plate 507, thereby setting the liquid crystal layer 541 to a transmission state (step S113). Since the light converted into circularly polarized light is transmitted by the liquid crystal layer 541, the camera 74 is able to observe the interior of both the pressure chamber 52 and the common flow channel 55, simultaneously (step S114).

When foreign matter information has been obtained at step S114 and step S116, the voltage applied to the transparent electrodes 532 and 534 is switched off, and the liquid crystal layer 541 is changed to a state where it reflects circularly polarized light (step S119). In this case, the light is reflected by the liquid crystal layer 541 in the reflection control plate 507 and does not reflect the pressure chamber 52. Therefore, the camera 74 is able to observe the interior of the common flow channel 55 only (step S122).

When the second foreign matter information has been obtained at step S122 and step S124, the laser light source 271 is switched off (step S127). Thereafter, the processing (steps S128 to S142) is carried out as described in FIG. 10.

Figure 15A:
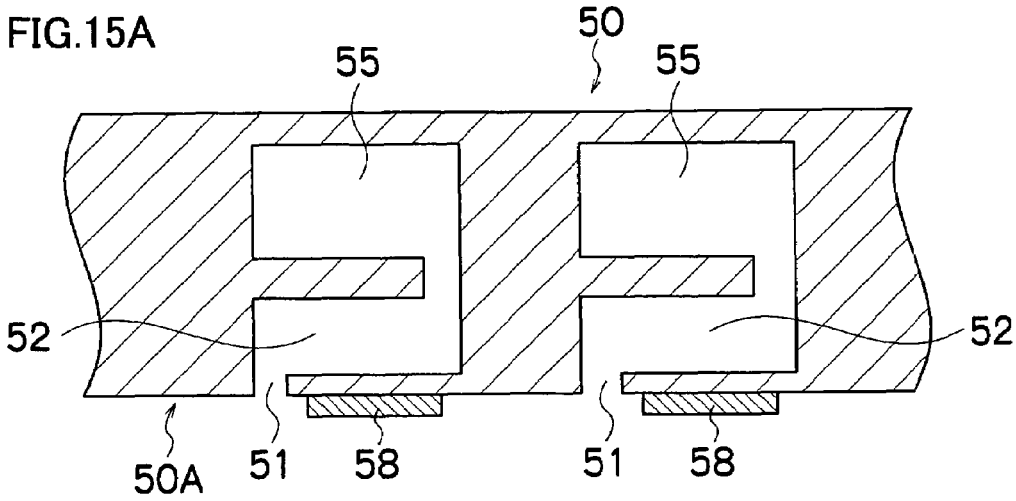
FIGS. 15A to 15C are cross-sectional diagrams showing an example of the composition of flow channel (flow chamber) formed inside the print head.

As shown in FIG. 15A, the print head 50 illustrated in FIG. 4 and FIG. 11 has a structure in which the pressure chamber 52 and the common flow channel 55 that supplies ink to that pressure chamber 52 are arranged in a layered fashion, such that are overlapping (or at least partially overlapping) in upper and lower positions in the direction of liquid discharge (a direction perpendicular to the nozzle surface 50A). However, the application of the present invention is not limited to a structure of this kind. For example, the present invention may also be applied to a structure such as that illustrated in FIG. 15B, where a pressure chamber 52 and a common flow channel 55 that supplies ink to the pressure chamber 52 are disposed in upper and lower positions on an oblique plane, in such a manner that the common flow channel 55 supplying ink to one pressure chamber 52 is situated immediately above the adjacently positioned pressure chamber 52.

Figure 15B:
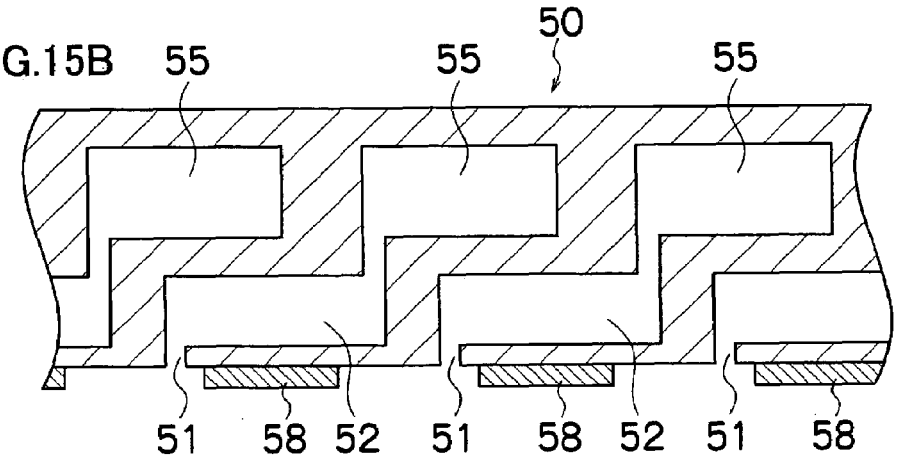
Figure 15C:
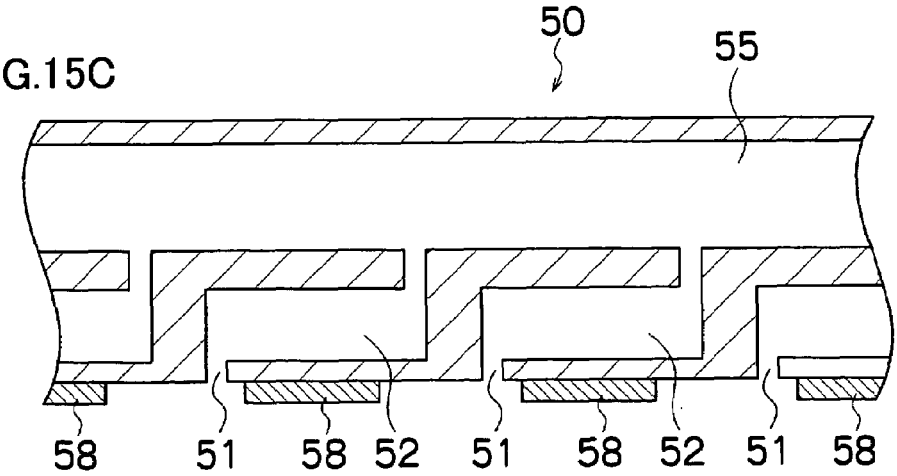

Furthermore, the present invention can also be applied to a print head 50 having a structure such as that illustrated in FIG. 15C, where the common flow passage 55 is not divided and a single common liquid chamber is used.

Naturally, the upper and lower positional relationship of the pressure chamber 52 and the common flow channel 55 can be switched in FIGS. 15A to 15C. Furthermore, in the present example, the pressure chamber 52 and the common flow channel 55 are disposed in upper and lower positions in the direction of lamination of the plate, but their positional relationship is not limited to this example, and various other positional relationships are possible in which the pressure chamber 52 and the common flow channel 55 are disposed separately to the front side and the rear side of a member that selectively reflects or transmits light. For example, they may be arranged in a horizontal direction (a direction perpendicular to the lamination direction).

Moreover, the flow channel section under observation is not limited to a pressure chamber and a common flow channel, and it may also include various combinations, such as a pressure chamber and another pressure chamber, a common flow channel and another common flow channel, any one of these liquid chambers and another liquid channel, and the like.

Next, a further compositional example of a nozzle chamber unit will be described.

As described in FIG. 4 and FIG. 11, the print head 50 according to the embodiments of the present invention has a structure in which an observation unit 27 is provided on the rear surface of the head, and therefore the head is a "nozzle surface vibration" type of inkjet head which applies pressure to ink by means of an actuator 58 bonded to the nozzle plate 510.

Figure 16:
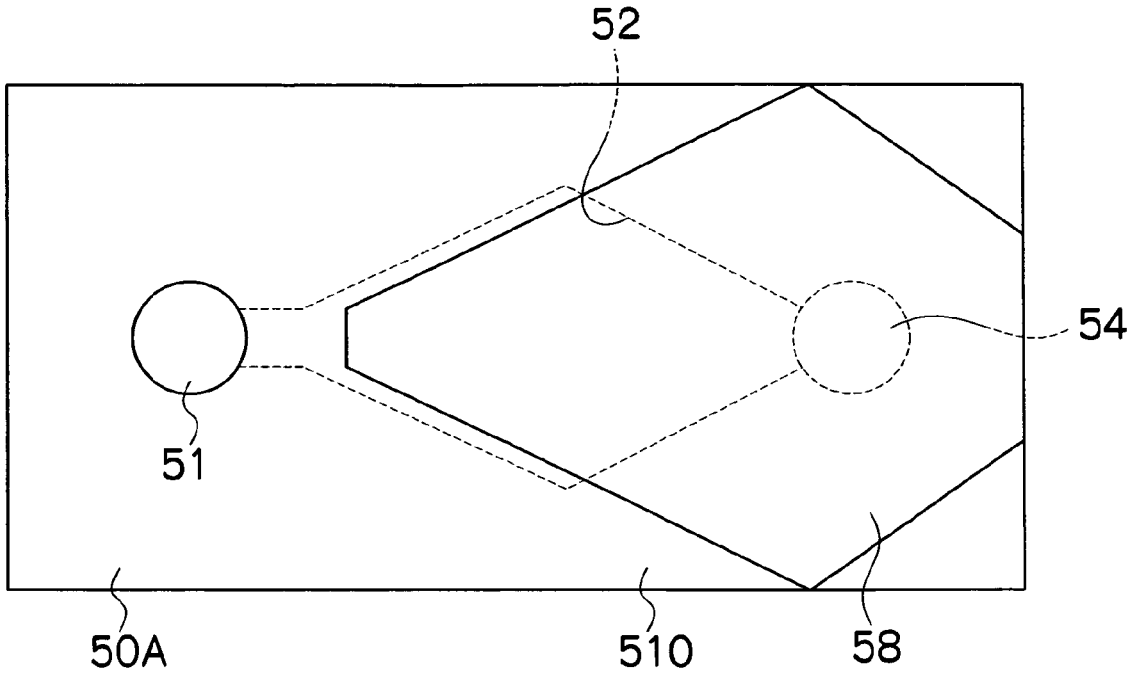
FIG. 16 is a plan view showing a further example of the composition of the ink chamber unit.

FIG. 16 is a plan diagram showing a further example of the structure of an ink chamber unit (liquid droplet discharge element) in a nozzle surface vibration type of head.

FIG. 16 shows a view of a nozzle plate 510 observed from the side corresponding to the nozzle surface 50A. Parts which are the same as or similar to those in FIG. 4 are labeled with the same reference numerals. More specifically, in FIG. 16, numeral 51 denotes a nozzle opening, numeral 52 denotes a pressure chamber, and numeral 58 denotes an actuator.

As shown in this diagram, the planar shape of the pressure chamber 52 is an approximate diamond shape (a parallelogram), the nozzle 51 being disposed at one of the apices situated on the longer diagonal of the diamond shape, and a supply port 54 being disposed at the other apex of this diagonal. If this composition is adopted, then stagnation is eliminated in the ink flow inside the pressure chamber 52, and removal of air bubbles is improved. The actuator 58 is disposed in such a manner that it covers as much as possible of the base surface of the pressure chamber 52 of the nozzle plate 510 and it is bonded to the nozzle plate 510.

Figure 17:
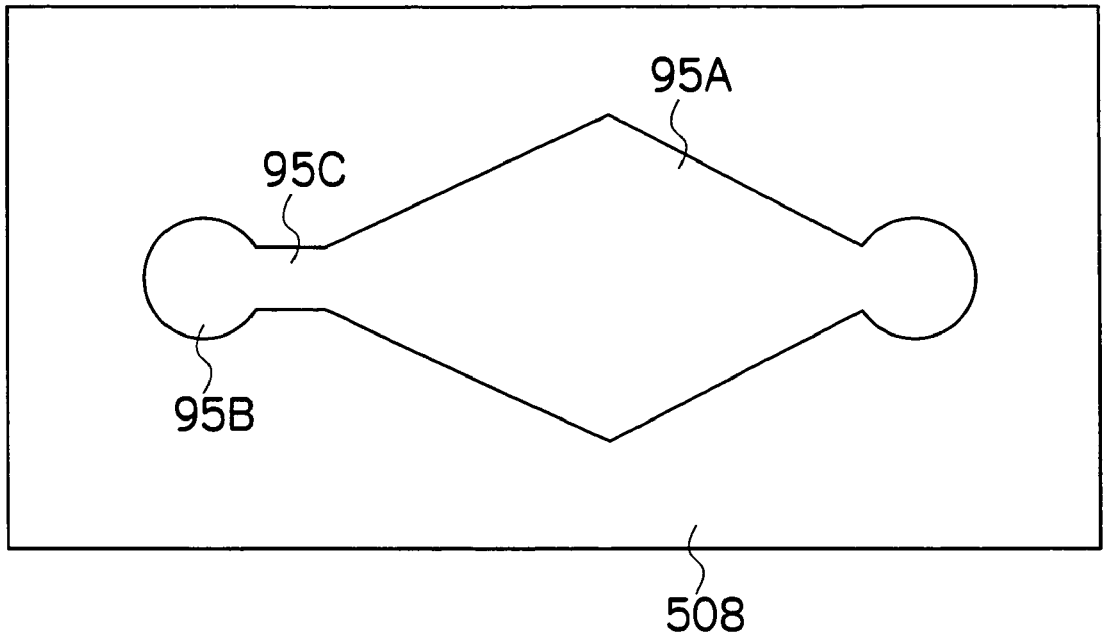
FIG. 17 is a plan view of a pressure chamber plate constituting the pressure chamber shown in FIG. 16.

FIG. 17 is a plan diagram of the pressure chamber plate 508 bonded to the pressure chamber 52 of the nozzle plate 510. As shown in the diagram, the pressure chamber plate 508 has a pressure chamber opening section 95A having a planar shape which is approximately diamond-shaped and forms a portion of the wall of the pressure chamber plate 508. Furthermore, it also functions as a supporting member which supports the perimeter of the nozzle in the nozzle plate 510 in order to restrict the movement (displacement) of the actual nozzle 51 during driving by the actuator 58 illustrated in FIG. 16.

More specifically, the pressure chamber plate 508 in FIG. 17 is formed with a partially circular-shaped opening section 95B of approximately the same diameter as the nozzle diameter, corresponding to the position of the nozzle, and this opening section 95B and the pressure chamber opening section 95A are connected by means of a cutaway section 95C. The perimeter of the nozzle 51 pierced through the nozzle plate 510 is supported by the perimeter material of the opening section 95B in the pressure chamber plate 508, thereby creating a state in which only the region of the nozzle 51 corresponding to the cutaway section 94C is not provided with a supporting member (namely, is in a unrestricted state).

In this way, by disposing an actuator 58 and a nozzle in close proximity, via a cutaway section 95C, the pressure generated by the actuator 58 is transmitted efficiently to the ink in the vicinity of the nozzle, and hence it is possible to discharge ink of high viscosity, which has poor fluidity. Furthermore, since the majority of the perimeter portion of the nozzle is supported by a pressure chamber plate 508, apart from the cutaway section 95C, the nozzle 51 is fixed within a range that does not adversely affect the transmission of force, and therefore the ink discharge direction can be stabilized.

FIG. 16 and FIG. 17 show examples where the opening section 95A in the pressure chamber is approximately diamond shaped, but the planar shape of the pressure chamber 52 is not limited to this, and it may have various other shapes, such as a quadrilateral shape other than a diamond, or a polygonal shape, elliptical shape, or the like.

Figure 18:
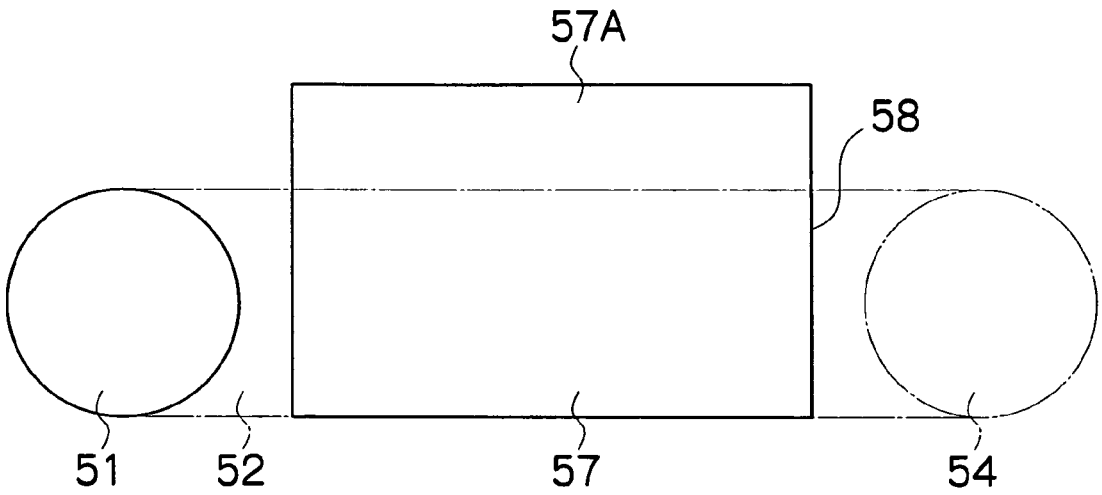
FIG. 18 is a plan view showing yet a further example of the composition of the ink chamber unit.

For example, it is also possible to obtain similar beneficial effects in the case of a pressure chamber 52 having a rectangular or square planar shape and a width approximately equal to the nozzle diameter, as shown in FIG. 18. In this case, the actuator 58 is an approximate rectangular shape or square shape, in accordance with the shape of the pressure chamber 52. The contact section (electrode lead section) 57A of the individual electrode 57 is desirably disposed in a fixed portion that is supported by the pressure chamber plate, avoiding the portion of the lower face where the pressure chamber 52 and actuator 58 lie in contact with each other.

Moreover, in the foregoing explanation, an inkjet recording apparatus was described as one example of an image forming apparatus, but the scope of application of the present invention is not limited to this. For example, the liquid droplet discharge device according to the present invention may also be applied to a photographic image forming apparatus in which developing solution is coated onto a printing paper by means of a non-contact method. Furthermore, the scope of application of the liquid droplet discharge device according to the present invention is not limited to an image forming apparatus, and the present invention may also be applied to various other types of apparatuses which spray a processing liquid, or other liquid, toward an ejection receiving medium by means of an ejection head (such as a coating device, or the like).

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid droplet discharge head, comprising:

a plurality of nozzles which discharge droplets of liquid;

a first flow channel section and a second flow channel section connected to at least one of the plurality of nozzles wherein at least a portion of a flow channel member forming at least one of the first flow channel section and the second flow channel section has light transmitting properties and a member which selectively reflects or transmits light is disposed between the first flow channel section and the second flow channel section;

a nozzle plate which constitutes a portion of at least one of the first flow channel section and the second flow channel section, the plurality of nozzles being formed in the nozzle plate; and an actuator which is provided on a discharge face side of the nozzle plate and causes the droplets of the liquid to be discharged from the nozzles by generating a pressure change in the liquid inside at least one of the first flow channel section and the second flow channel section.

2. A liquid droplet discharge head, comprising:

a plurality of nozzles which discharge droplets of liquid;

a first flow channel section and a second flow channel section connected to at least one of the plurality of nozzles wherein at least a portion of a flow channel member forming at least one of the first flow channel section and the second flow channel section has light transmitting properties and a dielectric multi-layer film mirror is disposed between the first flow channel section and the second flow channel section, said mirror having optical characteristics whereby the member transmits light of a prescribed transmission wavelength range and reflects light of a rescribed reflection wavelength range;

a light emitting device which irradiates light onto the at least one of the first flow channel section and the second flow channel section through the portion of the flow channel member having the light transmitting properties, wherein the light emitting device comprises a first light source which irradiates light of a wavelength included in the prescribed transmission wavelength range, and a second light source which irradiates light of a wavelength included in the prescribed reflection wavelength range; and a light receiving device which determines a status inside the at least one of the first flow channel section and the second flow channel section through the portion of the flow channel member having the light transmitting properties.

3. The liquid droplet discharge device as defined in claim 2, further comprising:

a light source control device which switches selectively between irradiation of light by the first light source and light by the second light source, onto the portion of the flow channel member having the light transmitting properties; and a foreign matter judgment device which judges presence and absence of foreign matter inside the flow channel sections, and a position of foreign matter, if foreign matter is present, according to first determination information obtained from the light receiving device during irradiation of light from the first light source, and second determination information obtained from the light receiving device during irradiation of light from the second light source.

4. The liquid droplet discharge device as defined in claim 3, further comprising:

a restoration device which restores discharge performance of the liquid droplet discharge head; and a restoration control device which controls a restoration operation performed by the restoration device, according to a judgment result from the foreign matter judgment device.

5. A liquid droplet discharge head, comprising:

a plurality of nozzles which discharge droplets of liquid;

a first flow channel section and a second flow channel section connected to at least one of the plurality of nozzles wherein at least a portion of a flow channel member forming at least one of the first flow channel section and the second flow channel section has light transmitting properties and a dielectric multi-layer film mirror is disposed between the first flow channel section and the second flow channel section, said mirror having optical characteristics whereby the member transmits light of a prescribed transmission wavelength range and reflects light of a rescribed reflection wavelength range;

a light emitting device which irradiates light onto the at least one of the first flow channel section and the second flow channel section through the portion of the flow channel member having the light transmitting properties; and a light receiving device which determines a status inside the at least one of the first flow channel section and the second flow channel section through the portion of the flow channel member having the light transmitting properties, wherein the light receiving device comprises a first light receiving section having a determination wavelength peak sensitivity included in the prescribed transmission wavelength range, and a second light receiving section having a determination wavelength peak sensitivity included in the prescribed reflection wavelength range.

6. The A liquid droplet discharge head, comprising:

a plurality of nozzles which discharge droplets of liquid;

a first flow channel section and a second flow channel section connected to at least one of the plurality of nozzles wherein at least a portion of a flow channel member forming at least one of the first flow channel section and the second flow channel section has light transmitting properties and a member which selectively reflects or transmits light is disposed between the first flow channel section and the second flow channel section, wherein the member disposed between the first flow channel section and the second flow channel section is a cholesteric liquid crystal having optical characteristics whereby reflection and transmission of light is controllable in accordance with an applied voltage;

a light emitting device which irradiates light onto the at least one of the first flow channel section and the second flow channel section through the portion of the flow channel member having the light transmitting properties; and a light receiving device which determines a status inside the at least one of the first flow channel section and the second flow channel section through the portion of the flow channel member having the light transmitting properties.

7. The liquid droplet discharge device as defined in claim 6, wherein circularly polarized light is irradiated from the light emitting device.

8. The liquid droplet discharge device as defined in claim 6, further comprising:

a voltage control device which controls the voltage applied to the cholesteric liquid crystal; and a foreign matter judgment device which judges presence and absence of foreign matter inside the flow channel sections, and a position of the foreign matter, if foreign matter is present, according to first determination information obtained from the light receiving device when the cholesteric liquid crystal is in a light transmitting state, and second determination information obtained from the light receiving device when the cholesteric liquid crystal is in a light reflecting state.

9. The liquid droplet discharge device as defined in claim 8, further comprising:

a restoration device which restores discharge performance of the liquid droplet discharge head; and a restoration control device which controls a restoration operation performed by the restoration device, according to a judgment result from the foreign matter judgment device.

* * * * *